US007403135B1

(12) United States Patent
Kaski et al.

(10) Patent No.: US 7,403,135 B1
(45) Date of Patent: Jul. 22, 2008

(54) CAPACITIVE RELAY TAKEOFF SWIMMING PLATFORM SENSOR SYSTEM

(75) Inventors: Kurt R. Kaski, Lake Norden, SD (US); Allen J. VanBemmel, Brookings, SD (US); Jason C. Warne, Brookings, SD (US)

(73) Assignee: Daktronics, Inc., Brookings, SD (US)

( * ) Notice: Subject to any disclaimer, the term of this patent is extended or adjusted under 35 U.S.C. 154(b) by 0 days.

(21) Appl. No.: 11/796,756

(22) Filed: Apr. 30, 2007

Related U.S. Application Data

(63) Continuation-in-part of application No. 10/750,639, filed on Dec. 22, 2003.

(51) Int. Cl.
*H03M 11/00* (2006.01)

(52) U.S. Cl. ..... 341/33; 341/20; 307/125; 307/166; 307/119; 700/600; 340/530

(58) Field of Classification Search ..... 341/20, 341/22, 33; 200/512, 52 R, 600; 377/15; 307/119, 116, 125; 340/530, 545.4, 323 R
See application file for complete search history.

(56) References Cited

U.S. PATENT DOCUMENTS

| | | | | |
|---|---|---|---|---|
| 3,916,214 | A * | 10/1975 | Coble et al. | 307/119 |
| 3,944,763 | A * | 3/1976 | Beierwaltes | 200/52 R |
| 4,292,696 | A * | 10/1981 | Berger | 4/505 |
| 4,394,643 | A * | 7/1983 | Williams | 341/33 |
| 6,225,711 | B1 * | 5/2001 | Gupta et al. | 307/125 |
| 6,713,897 | B2 * | 3/2004 | Caldwell | 307/125 |
| 7,030,513 | B2 * | 4/2006 | Caldwell | 307/116 |
| 7,119,799 | B2 * | 10/2006 | Kaski | 345/173 |
| 2004/0104826 | A1 * | 6/2004 | Philipp | 341/34 |

* cited by examiner

*Primary Examiner*—Albert K. Wong
(74) *Attorney, Agent, or Firm*—Hugh D. Jaeger, Esq.

(57) ABSTRACT

A capacitive relay takeoff swimming platform sensor system including multiple stations, timing devices and capacitive sensor devices where the presence or departure of a second swimmer on a relay takeoff swimming platform is sensed by the change in capacitance of a sensor mat and compared to the arrival of a first swimmer at a touchpad sensor. The system includes automatic recalibration of sensing, such that presence of a swimmer is sensed and then system recalibrated so as to detect departure of the swimmer. The sensor mat includes an polycarbonate perimeter.

34 Claims, 31 Drawing Sheets

CAPACITIVE RELAY TAKEOFF SWIMMING PLATFORM SENSOR SYSTEM

CROSS REFERENCES TO RELATED APPLICATIONS

This patent application is a continuation-in-part of application Ser. No. 10/750,639 filed on Dec. 22, 2003, entitled "Capacitive Relay Takeoff Swimming Platform Sensor System", which is pending.

BACKGROUND OF THE INVENTION

1. Field of the Invention

The present invention is for a swimming event timing device, and more particularly, pertains to a capacitive relay takeoff swimming platform sensor system.

2. Description of the Prior Art

Various sensing and measuring devices and schemes have been incorporated during relay swimming events where a first relay swimmer is required to contact a touchpad sensor at the edge of a swimming pool adjacent to a second relay swimmer who then is allowed to depart in the relay sequence from a relay takeoff swimming platform (also referred to as a starting platform). Departure from the relay takeoff swimming platform is dependent on observations and timing skills of the second relay swimmer who, undesirably, may leave the starting platform prior to the touching of the touchpad sensor by the first relay swimmer. Premature departure of the second relay swimmer from the relay takeoff swimming platform can be cause for disqualification; and the International Amateur Swimming Federation (FINA) contemplates such by FINA Rule SW 10.10 which states: "In relay events, the team of a swimmer whose feet lose touch with the starting platform before the preceding teammate touches the wall shall be disqualified, unless the swimmer in default returns to the original starting point at the wall, but it shall not be necessary to return to the starting platform." This rule pertains to relay exchanges in a relay event, and is different from the rule for the start of a race, which states that any movement before the start will disqualify the competitor. In a relay exchange, the second swimmer on the relay takeoff swimming platform can legally be completely horizontal with one toe touching the relay takeoff swimming platform when the first swimmer in the water touches the touchpad sensor on the wall.

In current practice, it is difficult for an electronic timing system to detect the actual instant the second swimmer loses all contact with the relay takeoff swimming platform. Currently available relay takeoff sensors rely on measuring the force exerted by the second swimmer on the relay takeoff swimming platform, some using a mechanical switch mechanism in the relay takeoff swimming platform top, others using a pressure sensitive piezo device. Experiments have been conducted with this latter method using load cells and accelerometers. It has been demonstrated that the accuracy of force measurement methods is limited by the fact that the swimmer may have one toe in contact with the relay takeoff swimming platform, but exert an immeasurable force against it. This results in the start being signaled before it has actually occurred. Because of this, FINA allows a tolerance of 0.03 second in relay exchange timing. In other words, a swimmer will not be disqualified unless the timing system shows a departure more than 0.03 second before the swimmer in the water touches the touchpad sensor. The "0.03 second" figure was established in tests using an Omega Sports Timing starting block, which showed that the signal from the relay takeoff swimming platform was consistently between 0.024 and 0.027 seconds before the actual departure.

What is needed is a system which will give an accurate measurement of the relay exchange time and which can sense contact between the second swimmer and the relay takeoff swimming platform without regard to force. Such a system is provided by the inventor by incorporating capacitive touch sensing technology. More specifically, a sensing mat, including onboard sensing circuitry, senses a capacitive field, and the change in the capacitive field generated by the second swimmer is used to derive accurate swim relay sensing and timing information within desired and approved parameters.

SUMMARY OF THE INVENTION

The general purpose The general purpose of the present invention is to provide a capacitive relay takeoff swimming platform sensor system.

According to the present invention the system can include multiple like components stationed and arranged along and at the ends of multiple swimming pool lanes used for timing of relay swimming events. The capacitive relay takeoff swimming platform sensor system is incorporated at least at one swimming lane station, but preferably at all swimming lane stations, each swimming lane station having a relay takeoff swimming platform (starting platform) the components of which include a sensing mat and a closely located sensor circuit in a housing which are a part of the relay takeoff swimming platform, a cable connecting the sensor circuit to a lane module, and a touchpad and touchpad sensor mounted on the swimming pool at the lane end being connected to the lane module by a cable. The lane modules at each swimming lane station are connected by cables to a timer and start system for conducting starts and finishes at each swimming lane station and for analyzing data at the relay takeoff swimming platforms with respect to the arrivals of first relay swimmers at the pool edges and the departures of second relay swimmers at the relay takeoff swimming platforms. A scoreboard is also connected as part of the system to annunciate swimming event elapsed times or other data as desired.

The arrival of the first relay swimmer is sensed by contact with the touchpad sensor mounted on the associated swimming pool lane end, and the departure of the second relay swimmer from the relay takeoff swimming platform is sensed by the sensing mat. Departure of the second relay swimmer from the relay takeoff swimming platform is detected by a change of the capacitance level around and about the upper regions of the sensing mat at the outboard end of the relay takeoff swimming platform when the second relay swimmer influences the capacitance level by departure from the relay takeoff swimming platform. An integrated circuit incorporated with adjoining circuitry is contained in a housing mounted adjacent to one edge of the sensing mat to sense the capacitance level and the influence thereof adjoining the upper region of the sensing mat. The sensing mat is constructed of multiple layers, where being protective layers, some being electrically insulative layers, and some being electrically conductive layers which are opposed and form sensor or other purpose electrodes. The sensor electrode is incorporated to monitor the capacitance of the region at the upper region of the sensing mat. When the monitored capacitance is increased/decreased by the departure of the second relay swimmer from the relay takeoff swimming platform, such capacitance change is detected by the integrated circuit to denote and relay the departure of the second relay swimmer whereupon circuitry electronically simulates the closure of a switch for comparison of the departure time of the second relay swimmer to the arrival time of the first relay swimmer by the connected timer.

According to one or more embodiments of the present invention there is provided a capacitive relay takeoff swimming platform sensor system.

One significant aspect and feature of the present invention is a capacitive relay takeoff swimming platform sensor system which times a relay swimming event from start to finish.

Another significant aspect and feature of the present invention is a capacitive relay takeoff swimming platform sensor system which compares the arrival time of a first relay swimmer to the departure time of a second relay swimmer during a relay event.

Still another significant aspect and feature of the present invention is a capacitive relay takeoff swimming platform sensor system where the presence of a relay swimmer on or the absence of a relay swimmer from a relay takeoff swimming platform is detected.

Yet another significant aspect and feature of the present invention is a capacitive relay takeoff swimming platform sensor system where detection of the presence of a relay swimmer on or the absence of a relay swimmer from a takeoff swimming platform is accomplished by monitoring of a capacitive field.

Having thus mentioned certain significant aspects and features of the present invention, it is the principal object of the present invention to provide a capacitive relay takeoff swimming platform sensor system.

In another embodiment, the present invention is a capacitive relay takeoff swimming platform sensor system. The system can include multiple like components stationed and arranged along and at the ends of multiple swimming pool lanes used for timing of relay swimming events. The capacitive relay takeoff swimming platform sensor system is incorporated at least at one swimming lane station, but preferably at all swimming lane stations, each swimming lane station having a relay takeoff swimming platform (starting platform) the components of which include a sensing mat with an insulating perimeter, preferably of polycarbonate, and a sensor circuit in a housing, and a touchpad and touchpad sensor mounted on the swimming pool at the lane end being connected to the lane module by a cable. It is especially preferred to employ a strap to attach the sensing mat atop the relay takeoff swim platform and employ the same strap to attach the housing, enclosing the sensing circuit, to the sensing mat. The lane modules at each swimming lane station are connected by cables to a timer and start system for conducting starts and finishes at each swimming lane station and for analyzing data at the relay takeoff swimming platforms with respect to the arrivals of first relay swimmers at the pool edges and the departures of second relay swimmers at the relay takeoff swimming platforms. Preferably, all the cables are shielded cables. A scoreboard is also connected as part of the system to annunciate swimming event elapsed times or other data as desired. A significant component in this alternative embodiment is a model QT9701 B2 IC from Quantum Research Group employed within the sensor circuit within the housing. This component includes automatic recalibration such that the relatively small changes in sensed capacitance can be detected in a complex environment subject to drift. Also significant to this alternative embodiment is the structure of the sensor mat, which employs a honeycomb layer, preferably polypropylene honeycomb layer, between a conductive sensor electrode and a conductive shield electrode both held in channels in the preferred polycarbonate perimeter. The preferred perimeter has a plurality of grooves, folded to allow the sensor mat to be non-planar. Preferably, the conductive sense electrode extends over this grooved portion of the sensor mat and continues onward into another portion of the sensor mat, but the conductive shield electrode and honeycomb do not continue into these portions.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
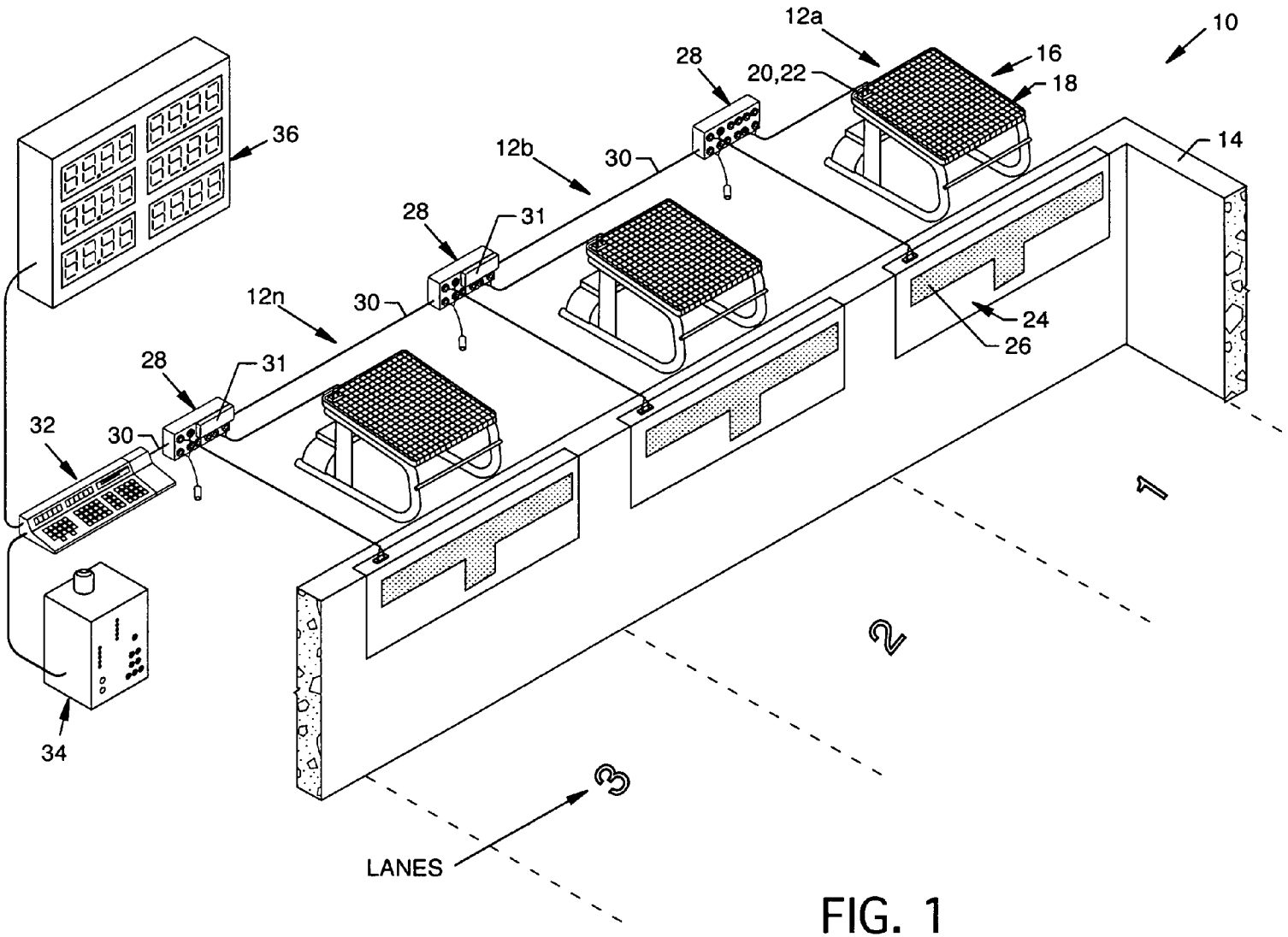
FIG. 1 is an isometric view of a capacitive relay takeoff swimming platform sensor system, the present invention, shown in conjunction with and located at or near the end of a plurality of swimming lane stations in a swimming pool, the present invention.
Figure 6A:
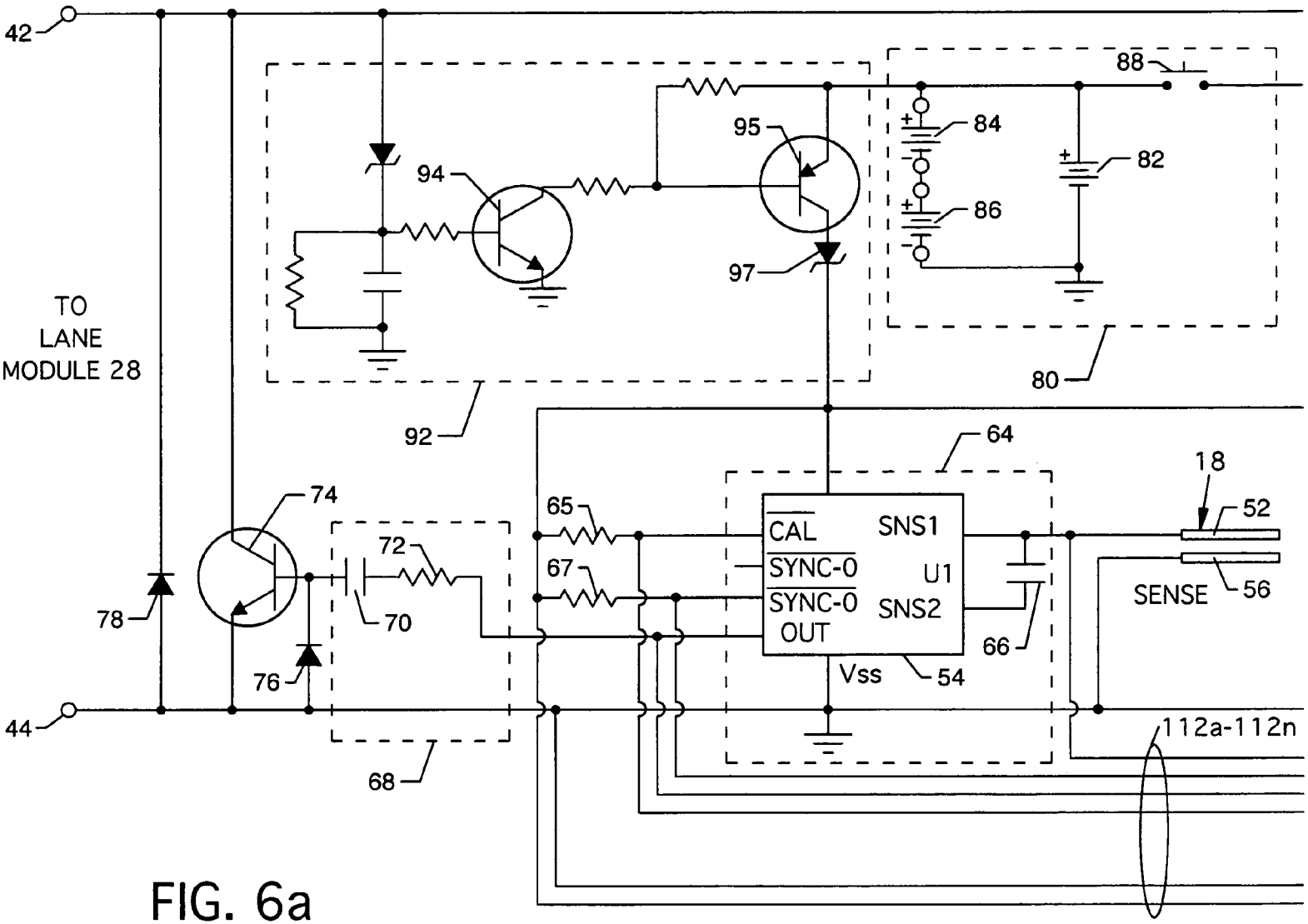
FIGS. 6*a* and 6*b*, when aligned as shown by FIG. 5, illustrate the sensor circuit schematic diagram for the sensor circuit.
Figure 6B:
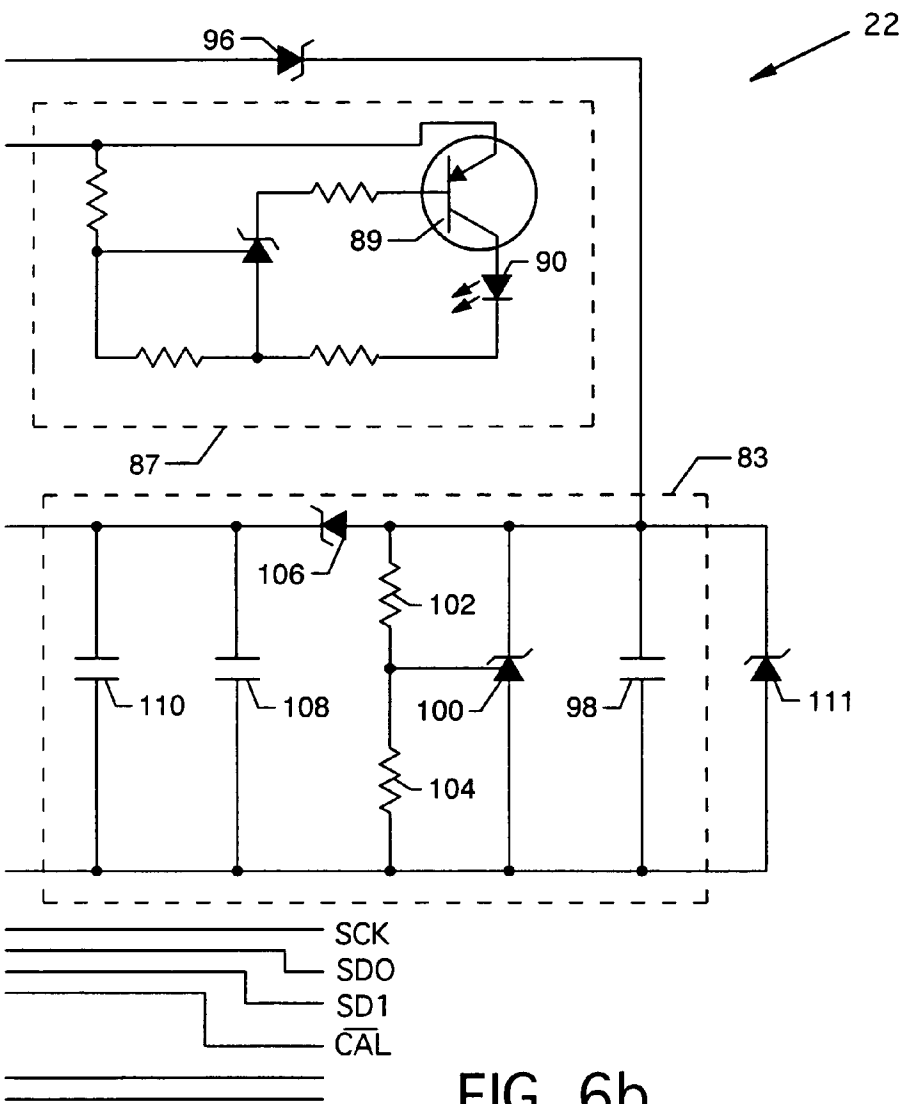

FIG. 1 is an isometric view of a capacitive relay takeoff swimming platform sensor system 10, the present invention, shown in conjunction with and located at or near the end of a plurality of swimming lane stations 12*a*-12*n* in a swimming pool 14 where each of the swimming lane stations 12*a*-12*n* is similar in design and construction and has a commonality of components. The swimming lane station 12*a* includes a relay takeoff swimming platform 16 the components of which include a sensing mat 18 and a closely located housing 20 surrounding a sensor circuit 22 (FIGS. 6*a*-6*b*). A touchpad 24, having a touchpad sensor 26 the operation of which is disclosed in U.S. Pat. No. 6,156,987 by the same inventor, is located at one end of the swimming pool lane 1 to signal arrival of a swimmer for timing signal purposes. A lane module 28 connects to the sensor circuit 22 on the relay takeoff swimming platform 16 and to the touchpad 24. As illustrated, multiple lane modules 28 are connected at their respective swimming lane stations 12*a*-12*n* and are interconnected by cables 30 and plugs 31 to each other and to a timer 32. A plug 31 also connects cable 30 to the rear of the timer 32 (not shown). A start system 34, which can include visual and aural starting devices, is connected to the timer 32. A scoreboard 36 is also included being connected to the timer 32.

Figure 2:
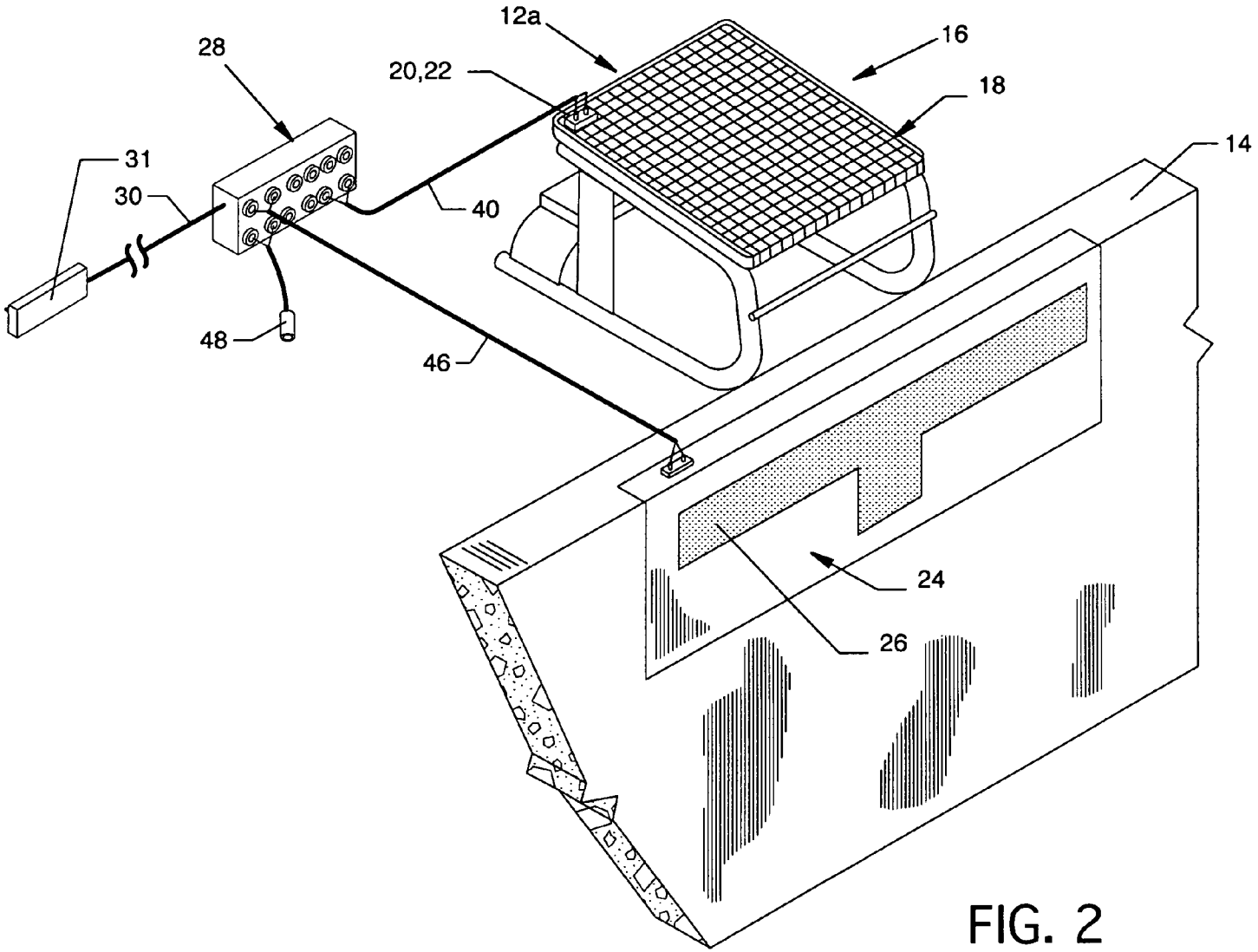
FIG. 2 is an isometric view of a swimming lane station located at one end of the swimming pool showing the connection of the sensing mat and the sensor circuit to a lane module.

FIG. 2 is an isometric view of the swimming lane station 12*a* located at one end of the swimming pool 14 showing the connection of the sensing mat 18 and the sensor circuit 22 to a lane module 28. Suitable electrical connectors, such as banana plugs 38, at one end of a cable 40 engage other suitable electrical connectors, such as jacks 42 and 44 (FIG. 3), located at the housing 20 to connect the sensor circuit 22 to the lane module 28. Suitable connectors at the ends of a cable 46 are also provided to electrically attach the touchpad sensor 26 of the touchpad 24 to the lane module 28. The lane module 28 can include one or more corded control buttons 48 for use by swimming judges to manually input event time references into the lane module 28.

Figure 3:
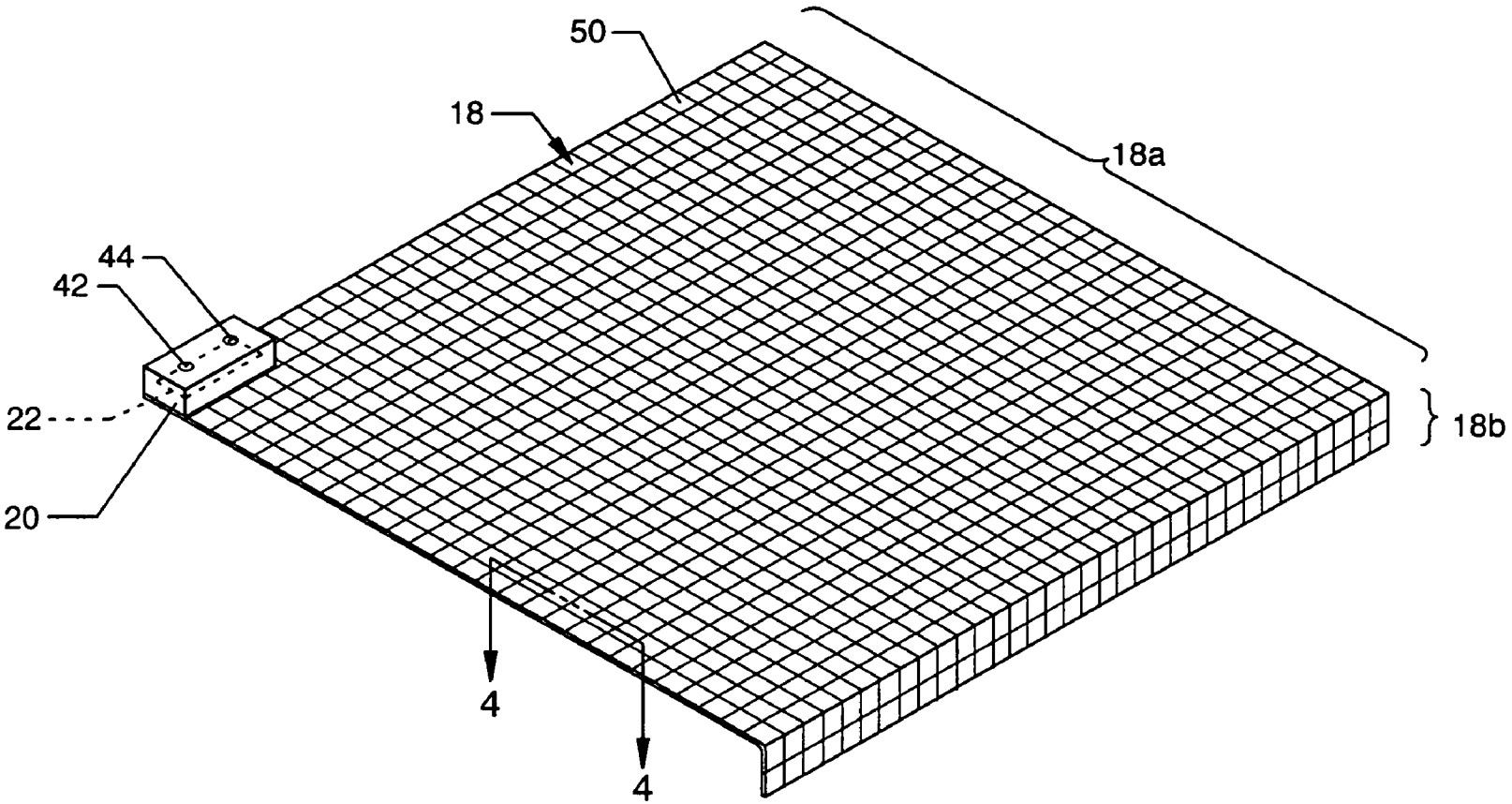
FIG. 3 is an isometric view of the sensing mat and the housing including the sensor circuit and jacks.

FIG. 3 is an isometric top view of the sensing mat 18 and the housing 20 including the sensor circuit 22 and the jacks 42 and 44 which receive the banana plugs 38 for electrical connection of the output of the sensor circuit 22 to the lane module 28 via the cable 40. The sensing mat 18 which is layered and is part of the relay takeoff swimming platform 16, includes a horizontally oriented portion 18*a* which aligns along and about the horizontally oriented planar end of the relay takeoff swimming platform 16 overlying the swimming pool 14 for adequate and controlled physical and capacitive contact with all or a major portion of a dry or wet swimmer's feet and a vertically oriented portion 18*b* which is contiguous and continuous with and extends downwardly from the horizontally oriented portion 18*a* for adequate and controlled physical and capacitive contact of a portion of a swimmer's wet or dry feet and/or toes, as required. The outer surface of the sensing mat 18 includes an electrically conductive exterior layer 50 textured or otherwise formed to enhance suitable non-slip contact with the dry or wet feet and/or toes or portions thereof of a swimmer.

Figure 4:
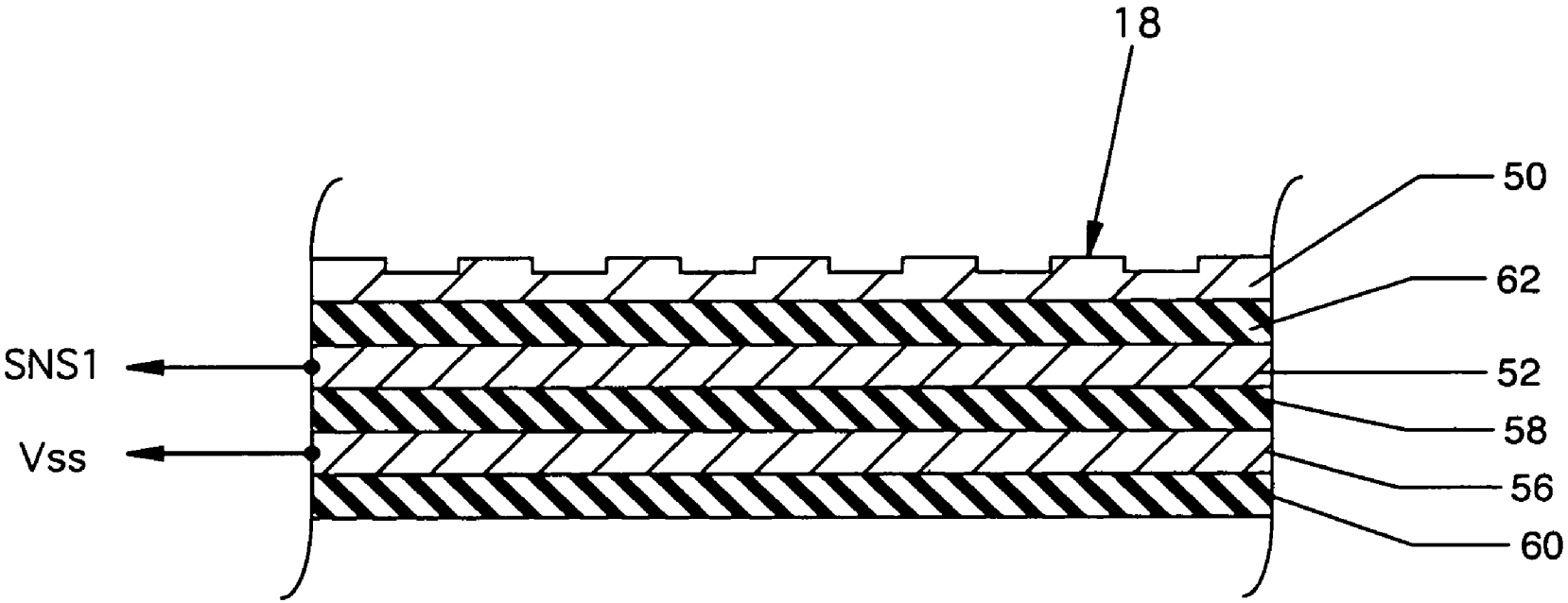
FIG. 4 is an enlarged cross section view of the sensing mat along line 4-4 of FIG. 3 showing the layered construction including alternating electrical conductor and electrical insulator layers.

FIG. 4 is an enlarged cross section view of the sensing mat 18 along line 4-4 of FIG. 3 showing the layered construction including alternating electrical conductor, electrode, and electrical insulator layers suitably fashioned where a suitable adhesive or other bonding means is incorporated (not shown) to bond the conductor, electrode and insulator layers together substantially into a structure which maintains integrity and suitable electrical and physical qualities even when not assuming an entirely planar shape. The sensing mat 18 electrically connects to the sensor circuit 22 incorporating a charge-transfer touch integrated circuit 54 (FIGS. 6*a*-6*b*) which fosters projection of a capacitive sense field around a conductive sense electrode 52 central to the sensing mat 18. The charge-transfer touch integrated circuit 54 can be a QT310 capacitive sensor IC (from Quantum Research Group) utilizing a proprietary charge transfer sensing algorithm. Disruption or change of the capacitive sense field about the conductive sense electrode 52 connected to the SNS1 terminal of the charge-transfer touch integrated circuit 54 in the sensor circuit 22 is detected to signal swimmer departure. The behavior of the capacitive sense field about the sensing mat 18 is influenced by the conductive exterior layer 50 to evenly distribute the capacitive sense field projected by the conductive sense electrode 52 for uniform sensing and to diminish the capacitive sense field to ensure that the conductive sense electrode 52 will be sensitive to touch and not mere proximity. A conductive ground electrode 56 opposes the conductive sense electrode 52 with an insulator layer 58 disposed therebetween. The conductive ground electrode 56 in opposition to the conductive sense electrode 52 increases the overall capacitance across the sensing mat 18 to ensure a suitable response time as well as to shield the conductive sense electrode 52 from sensing nuisance touches in the underside region of the relay takeoff swimming platform 16. The conductive ground electrode 56 connects to the ground (Vss) of the sensor circuit 22. An insulator layer 60 is included on the underside of the conductive ground electrode 56 to insulate the conductive ground electrode 56 from a mounting surface such as provided by the relay takeoff swimming platform 16. Another insulator layer 62 is provided between the conductive sense electrode 52 and the conductive exterior layer 50 to insulate the conductive sense electrode 52 from the conductive exterior layer 50, as well as to provide protection of the conductive sense electrode 52. In the alternative, composite material can be incorporated into use in lieu of the conductive sense electrode 52, the insulator layer 58, and the conductive ground electrode 56, such as ACM (aluminum composite material), such as ALUCOBOND®. ACM includes a top layer of aluminum, a bottom layer of aluminum, and a polyethylene layer affixed therebetween forming a laminate. The top layer of aluminum corresponds to the conductive sense electrode 52, the polyethylene layer corresponds to the insulator layer 58, the bottom aluminum layer corresponds to the conductive ground electrode 56, and, if incorporated, a layer of paint applied to the upper surface of the top layer of aluminum corresponds to the insulator layer 62. The use of such a pre-formed laminate is beneficial in decreasing fabrication time.

Figure 5:
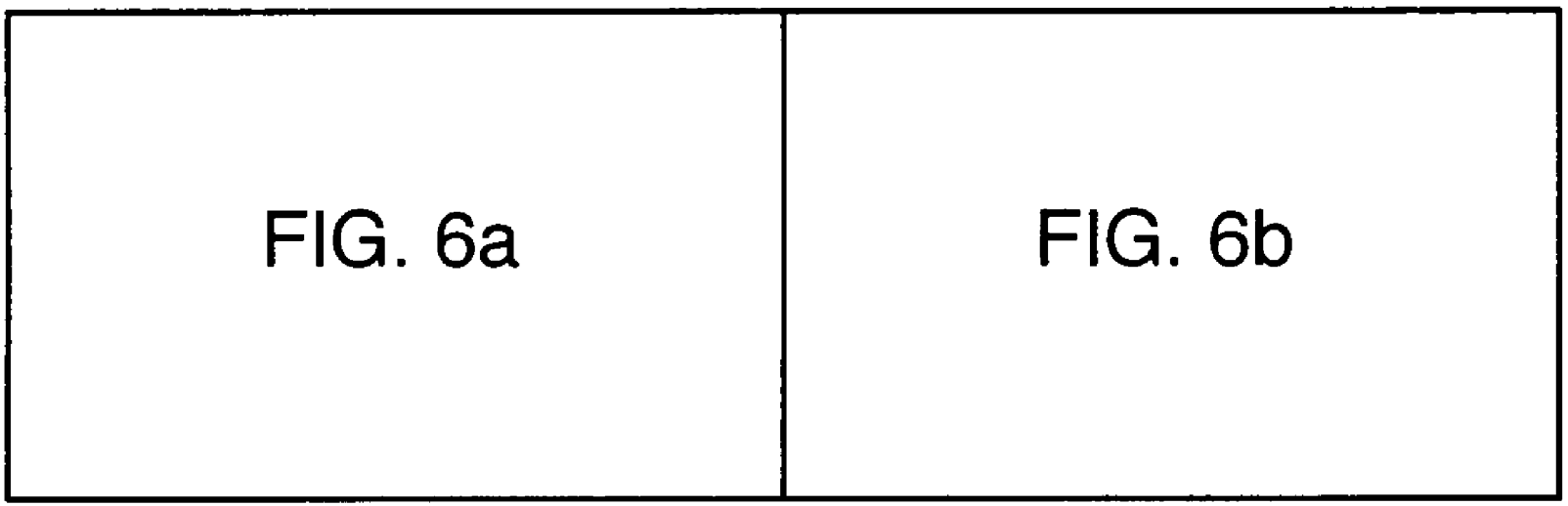
FIG. 5 shows the alignment of FIGS. 6*a* and 6*b* with respect to each other.

FIGS. 6*a* and 6*b*, when aligned as shown in FIG. 5, illustrates the sensor circuit 22 incorporated for detection of the variance of the capacitive sense field located around and about the sensing mat 18. Central to the operation of the sensor circuit 22 is a capacitive monitor circuit 64 which connects as previously described, to the conductive sense electrode 52 and to the conductive ground electrode 56. The capacitive monitor circuit 64 includes the charge-transfer touch integrated circuit 54 and a sampling capacitor 66 incorporated across SNS1 and SNS2 of the charge-transfer touch integrated circuit 54. The value of the sampling capacitor 66 can be changed as required to provide proper sensitivity for a given capacitance across the sensing mat 18 such as between the conductive sense electrode 52 and the conductive ground electrode 56. Resistors 65 and 67 also connect to the charge-transfer touch integrated circuit 54. An RC circuit 68 including a variable capacitor 70 and a resistor 72 is connected to the output of the charge-transfer touch integrated circuit 54 and the base of a switching transistor 74 is connected to the RC circuit 68. The collector and emitter of the switching transistor 74 are connected across the switch terminals, i.e., jacks 42 and 44, which lead to the lane module(s) 28 via the cable 40. A diode 76 connected across Vss and the base of the switching transistor 74 provides a discharge path for the capacitance, protecting the base emitter junction from excessive reverse voltage. A diode 78 across jacks 42 and 44 protects members of the sensor circuit 22 against reversed polarity in the event that the banana plugs 38 are installed reversed.

Preferably, operating power for the sensor circuit 22 is automatically supplied directly from the switch voltage across jacks 42 and 44 where the switch input will have one jack 42 pulled up through a resistor in the lane module 28. Voltage supplied by jack 42 powers a regulated power supply 83 of approximately 2.6 volts, for purpose of example and illustration. As later described in detail, power for the sensor circuit 22 power also can be automatically supplied by a battery circuit 80, which could utilize either a lithium battery 82 or batteries 84 and 86 as supplied. A battery test circuit 87 including a switching transistor 89 and other components, as shown, is also provided and is operated by a test switch 88 which is momentary and illuminates a light emitting diode 90 when a successful test is achieved.

Voltage across the jacks 42 and 44 is sampled by the sensor circuit 22. Low end voltages of lesser value, such value being at least 0.8 volt for purpose of example and illustration, are detected indicating a powered lane module 28 thereby allowing connection of the sensor circuit 22 in general to the lane module 28. If the detected voltage is high enough, power from the jacks 42 and 44 is utilized for powering of the sensor circuit 22. In general, the regulated power supply 83 supplies power and the battery circuit 80 is not utilized for supply power. If the detected voltage is insufficient for operation of the sensor circuit 22, the battery circuit 80 is utilized for powering the sensor circuit 22 in general. If no voltage is detected (no power supplied by the lane module 28), the battery protection circuit 92 completely and automatically disconnects the battery circuit 80 to preserve battery life. The battery protection circuit 92 includes switching transistors 94 and 95, a diode 97, and other components, as shown. Such an automatic feature is useful where manual switching (not provided) the batteries off when the system is not in use is not required, thereby preserving the batteries for future use.

The regulated power supply 83 receives positive operating voltage through the jack 42 and a diode 96. The regulated power supply 83 includes an input filter capacitor 98, a diode 100, resistors 102 and 104, a diode 106, an output filter capacitor 108, and a bypass capacitor 110 which protects the charge-transfer touch integrated circuit 54 from high frequency power supply fluctuations. A Zener diode 111 is also included across the regulated power supply 83 to protect the regulated power supply 83 by limiting the input voltage. Also included in the sensor circuit 22 are programming cables 112*a*-112*n* connected to the charge-transfer touch integrated circuit 54.

Mode of Operation

Reference to FIGS. 6*a*-6*b*, the description thereof, and the following, with occasional reference to other figures, best illustrates the mode of operation of the capacitive relay takeoff swimming platform sensor system 10.

When a swimmer is on the relay takeoff swimming platform 16, the capacitive field about the sensing mat 18, and especially the capacitive field about the region overlying the conductive sense electrode 52, is influenced by the capacitive field of the body of the swimmer and as such is detected and referenced by the charge-transfer touch integrated circuit 54. The output of the charge-transfer touch integrated circuit 54 is low when the swimmer is in physical contact with the sensing mat 18, whereby the capacitive field overlying the conductive sense electrode 52 is at a first level of capacitance. When the swimmer departs the relay takeoff swimming platform 16, the capacitive field about the region overlying the conductive sense electrode 52 is altered and such change in capacitance to a second level is detected. The change in capacitance drives the output of the charge-transfer touch integrated circuit 54 high. The high output of the charge-transfer touch integrated circuit 54 causes the switching transistor 74 to turn on, thereby sinking the switch voltage on jack 42 to ground to signal departure of the swimmer to the lane module 28 and thus signaling the timer 32 where other timer functions also occur for other segments of timing. The resistor 72 and capacitor 70 in the RC circuit 68 form a timing circuit that only allows the switching transistor 74 to stay on for X milliseconds, such time being adjustable by incorporating other capacitive values of the capacitor 70. This "pulse" output is necessary if the sensor circuit 22 is to be powered from the switch voltage supplied to jack 42 by the lane module 28, as previously partially explained. The supply power at the jack 42 will be interrupted whenever the switching transistor 74 turns on to signal a departure, so the diode 96 and capacitor 98 form a charge storage circuit to supply operating voltage to the capacitive monitor circuit 64 to keep the sensor circuit 22 running. Diodes 106 and 97 perform an "OR" of the battery circuit 80 voltage and the regulated power supply 83 voltage where the higher of the two voltages will power capacitive monitor circuit 64 and the sensor circuit 22 in general.

Figure 7:
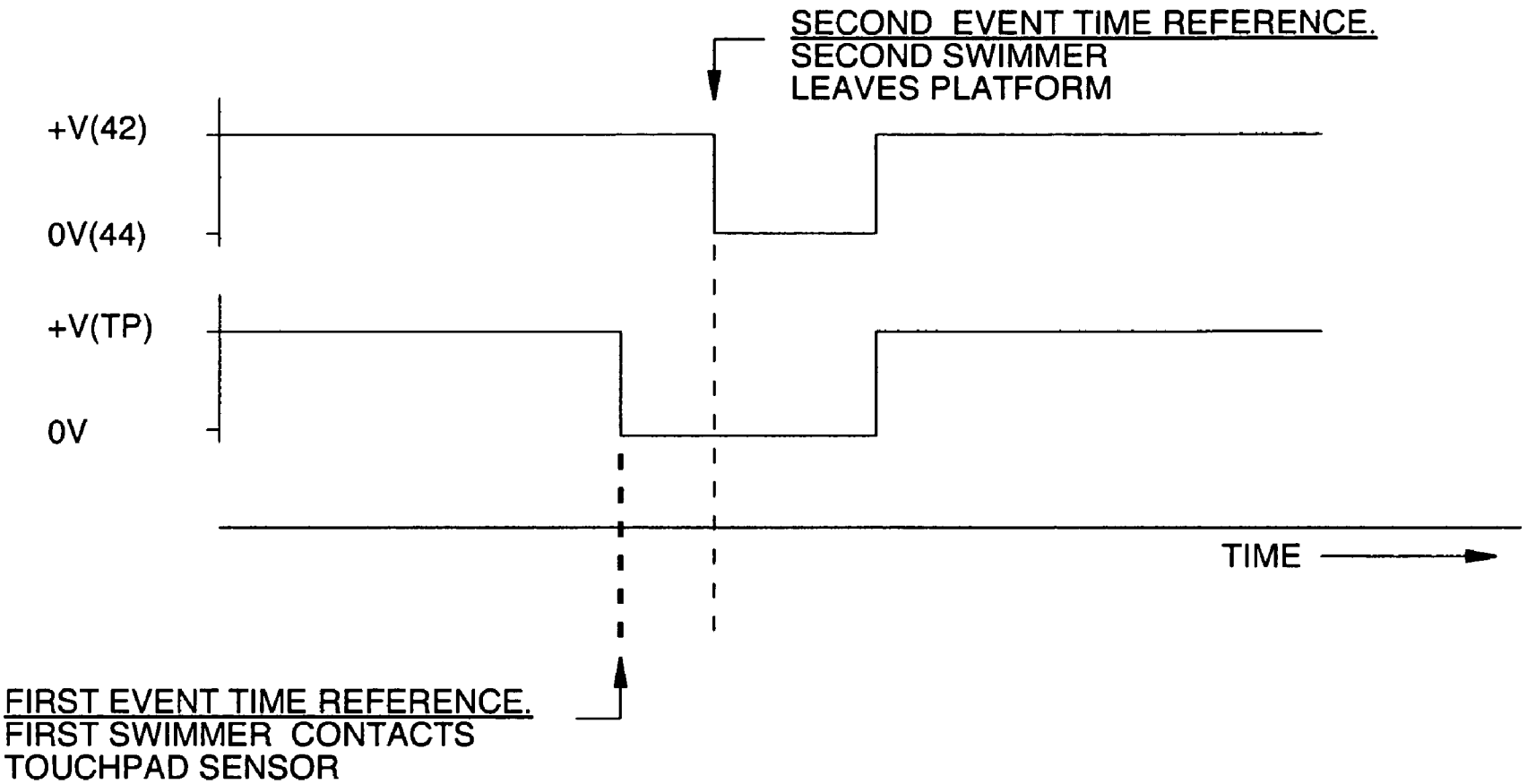
FIG. 7 illustrates a typical time interval and comparison measured by the capacitive relay takeoff swimming platform sensor system.
Figure 8:
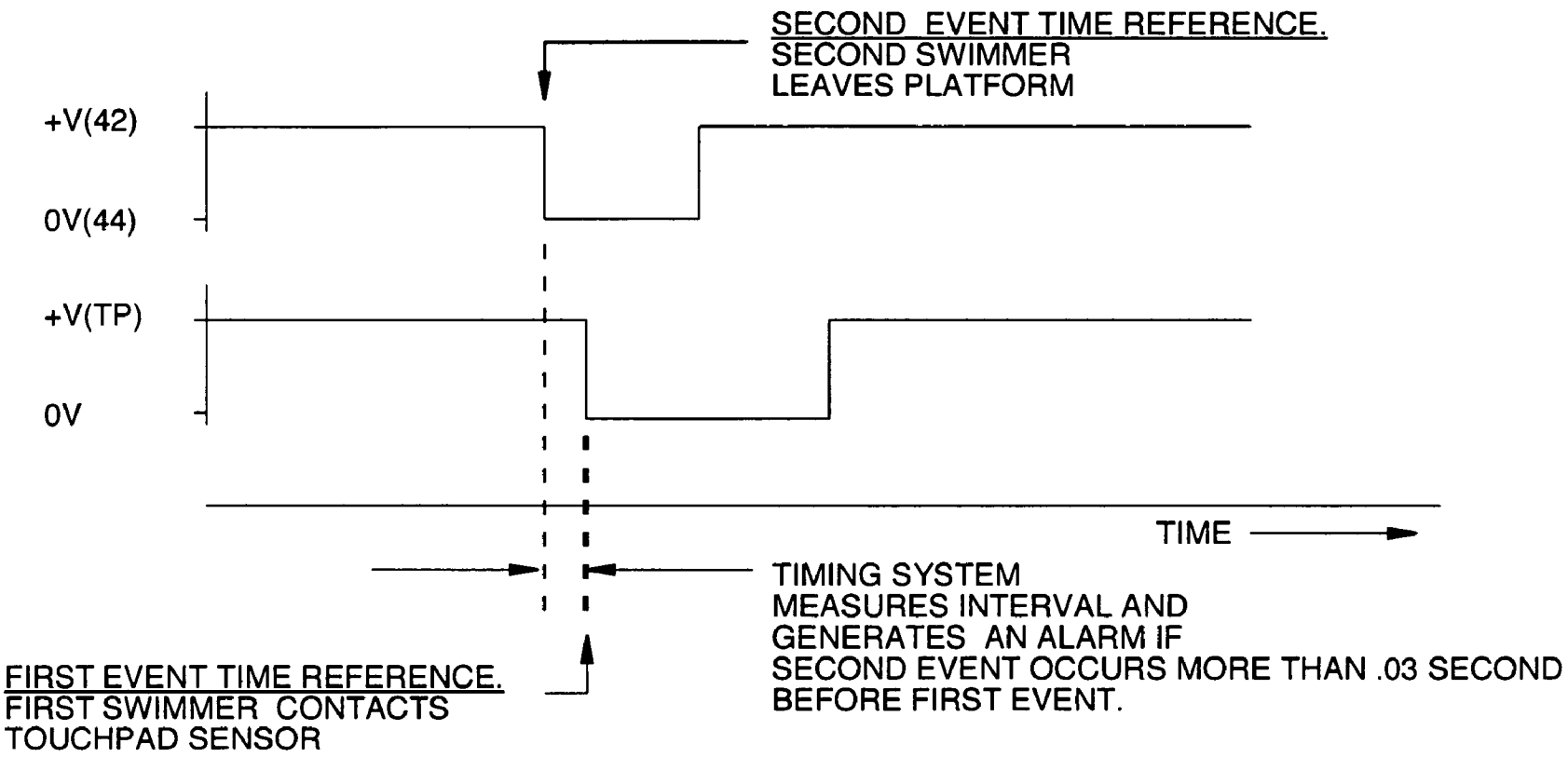
FIG. 8 illustrates a time interval and comparison measured by the capacitive relay takeoff swimming platform sensor system where a second swimmer departs early.

FIGS. 7 and 8 illustrate a time interval comparisons measured by the capacitive relay takeoff swimming platform sensor system 10. A first event time reference is established when a low voltage at the touchpad sensor 26 is detected upon the first swimmer contacting the touchpad sensor 26, and a second event time reference is established when a low voltage across jacks 42 and 44 is detected by the second swimmer leaving the sensing mat 18 on the relay takeoff swimming platform 16. The rules for swimming relays dictate that the first swimmer must touch the touchpad sensor before the second swimmer leaves the relay takeoff swimming platform. Under most circumstances, such sequence takes place, and this is illustrated in FIG. 7 where the time reference for the first event (viz., first swimmer contacting touchpad sensor) indicated by a bold dashed line appears before the time reference for the second event (viz., second swimmer leaving platform) denoted by a fainter dashed line. Ideally, and for maximum proficiency, the time references for the first and second events would coincide, and relay teams strive to achieve this ideal. However, occasionally the second event occurs before the first event. When this happens, a disqualification may occur. If the second event time reference occurs prior to the first event time reference, such sequence is noted, and notification thereof can be made visually or aurally by the timer 32 to denote an irregular relay sequence. As previously discussed, a tolerance of 0.03 second in relay exchange timing is acceptable for the purposes of relay event timing. Accordingly, a second swimmer will not be disqualified unless the timing system shows a departure of more than 0.03 second before the first swimmer in the water touches the touchpad sensor 26.

FIG. 8 illustrates an example of the second event occurring prior to the first event. If the time interval indicated by the distance between the faint and bold dashed lines is greater than 0.03 second, an alarm or other signal is given to indicate a disqualification.

Figure 9:
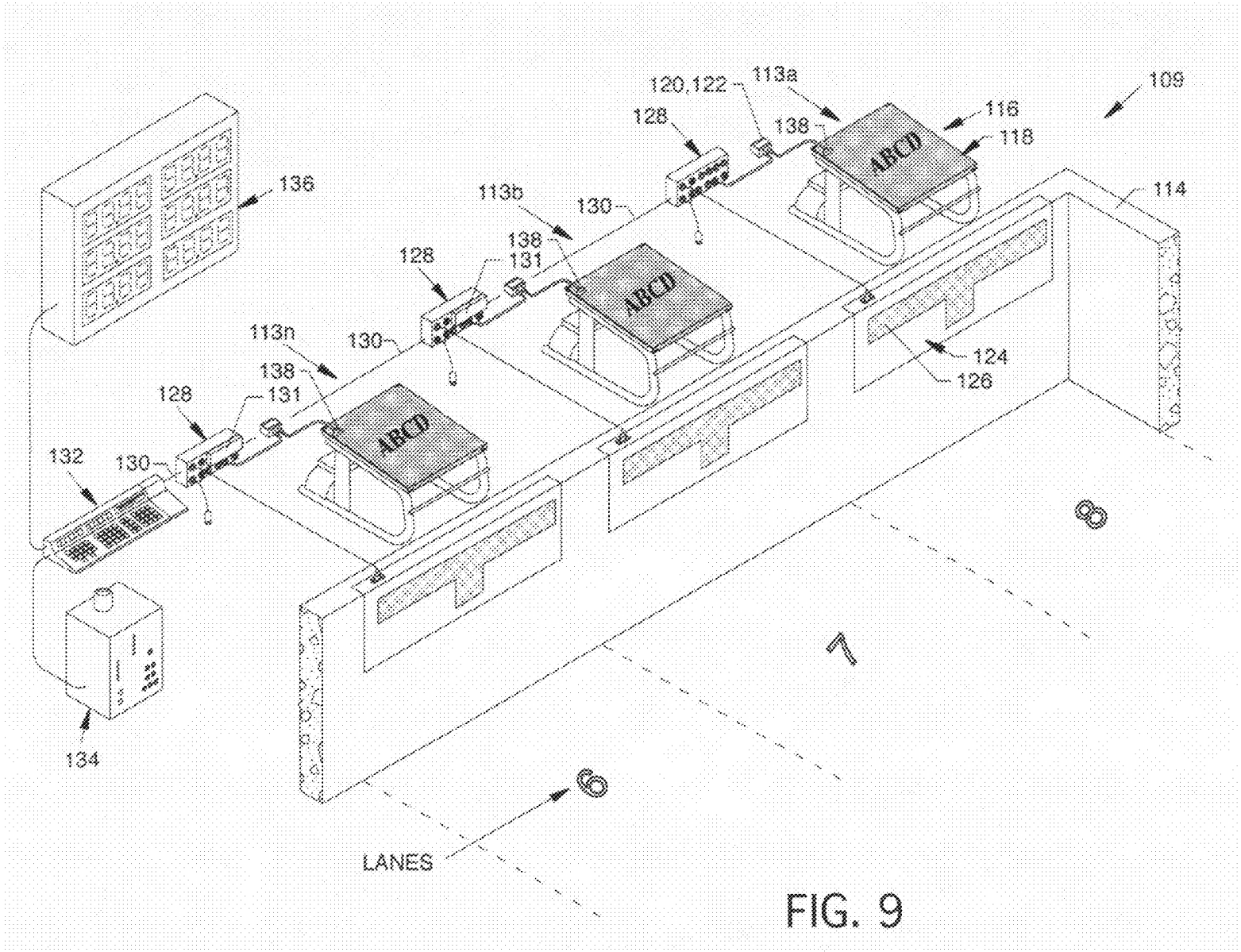
FIG. 9 is an isometric view of an alternative embodiment capacitive relay takeoff swimming platform sensor system of the present invention, shown in conjunction with and located at or near the end of a plurality of swimming lane stations in a swimming pool.

FIG. 9 is an isometric view of an alternative embodiment capacitive relay takeoff swimming platform sensor system 109, shown in conjunction with and located at or near the end of a plurality of swimming lane stations 113*a*-113*n* in a swimming pool 114 where each of the swimming lane stations 113*a*-113*n* is similar in design and construction and has a commonality of components. The swimming lane station 113*a* includes a relay takeoff swimming platform 116 the components of which include a sensor mat 118, preferably strapped upon the relay takeoff swimming platform 116, and a closely or remotely located housing 120 surrounding an alternative embodiment sensor circuit 122 (shown in detail in FIGS. 14A-14O). A touchpad 124, having a touchpad sensor 126 the operation of which is disclosed in U.S. Pat. No. 6,156,987, incorporated by reference in its entirety herein, is located at one end of the swimming pool lane 8 to signal arrival of a swimmer for timing signal purposes. Another method and apparatus for monitoring wet contact touchpads in swimming pools is disclosed in U.S. Pat. No. 7,119,798, incorporated by reference in its entirety herein. A lane module 128 connects to the alternative embodiment sensor circuit 122 on the relay takeoff swimming platform 116 and to the touchpad 124. As illustrated, multiple lane modules 128 are connected at their respective swimming lane stations 113*a*-113*n* and are interconnected by cables 130 and plugs 131 to each other and to a timer 132. A plug 131 also connects cable 130 to the rear of the timer 132 (not shown). A start system 134, which can include visual and audible starting devices, is connected to the timer 132. A scoreboard 136 is also included being connected to the timer 132.

Figure 10:
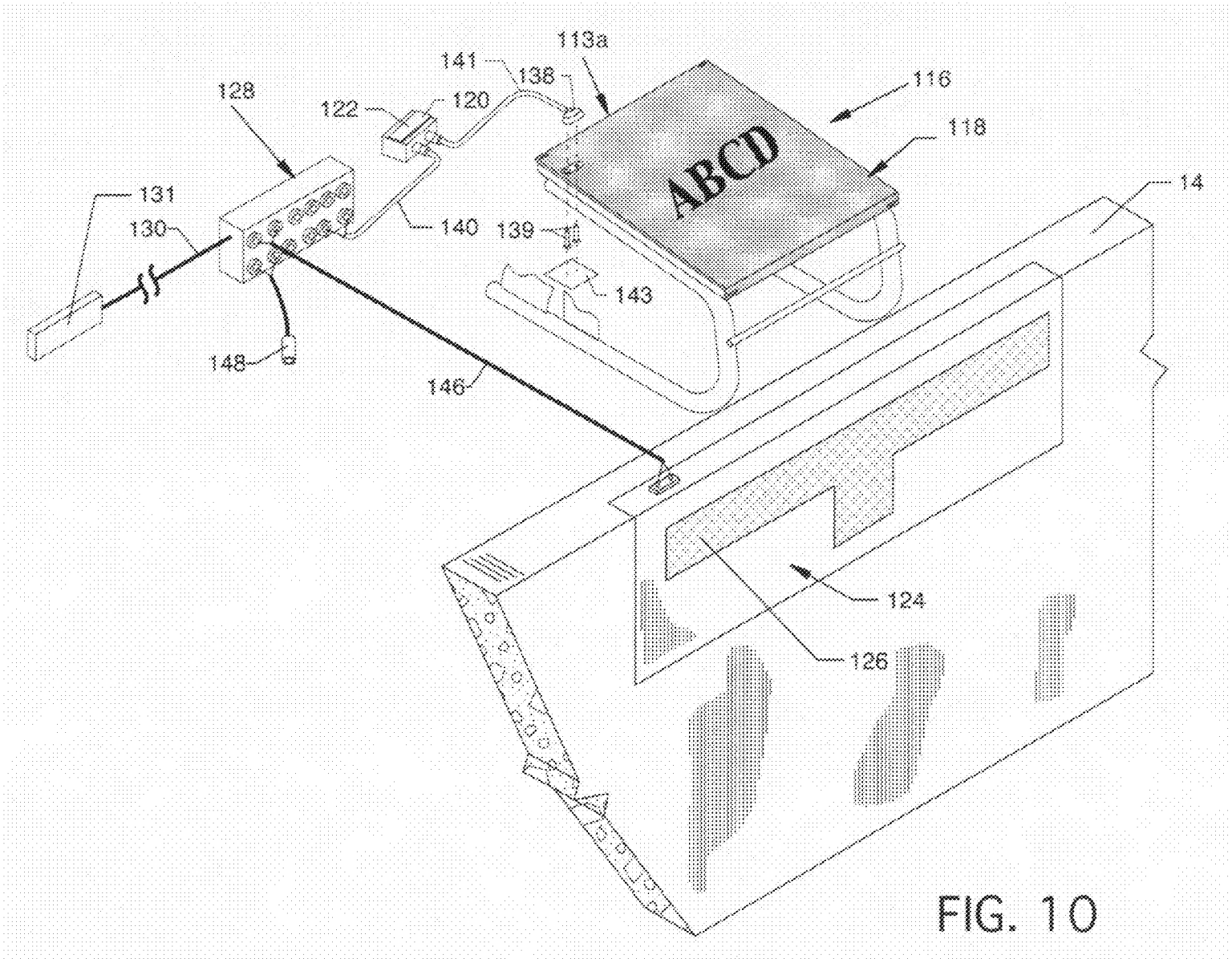
FIG. 10 is an isometric view of a swimming lane station located at one end of the swimming pool showing the connection of the sensing mat and the alternative embodiment sensor circuit to a lane module.

FIG. 10 is an isometric view of the swimming lane station 113*a* located at one end of the swimming pool 114 showing the connection of the sensor mat 118 and the alternative embodiment sensor circuit 122 within housing 120 to a lane module 128. Suitable electrical connectors 138 at one end of a cable 141 are connected to the sensor mat 118 by through bolted screws or bolts 139 to provide appropriate metal to metal contact so as to selectively engage conductive sense electrode 152 and/or the shield electrode 156 (shown in FIG. 12). Silicone grease is employed at the interface of electrical connector 138 and the sensor mat 118 to exclude drops of water from causing detrimental connections or shorts between the electrical connectors 138. Cable 141 leads to the housing 120 to connect the alternative embodiment sensor circuit 122. The alternative embodiment sensor circuit 122 within housing 120 is also connected to cable 14O leading, in turn, to the lane module 128. Heads of the screws or bolts 139, on the underside of the sensor mat 118, are covered with a patch 143 of clear label material to prevent shorts by excluding water droplets from the area about the screws or bolts 139. Suitable connectors at the ends of a cable 146 are also provided to electrically attach the touchpad sensor 126 of the touchpad 124 to the lane module 128. The lane module 128 can include one or more corded control buttons 148 for use by swimming judges to manually input event time references into the lane module 128.

Figure 11:
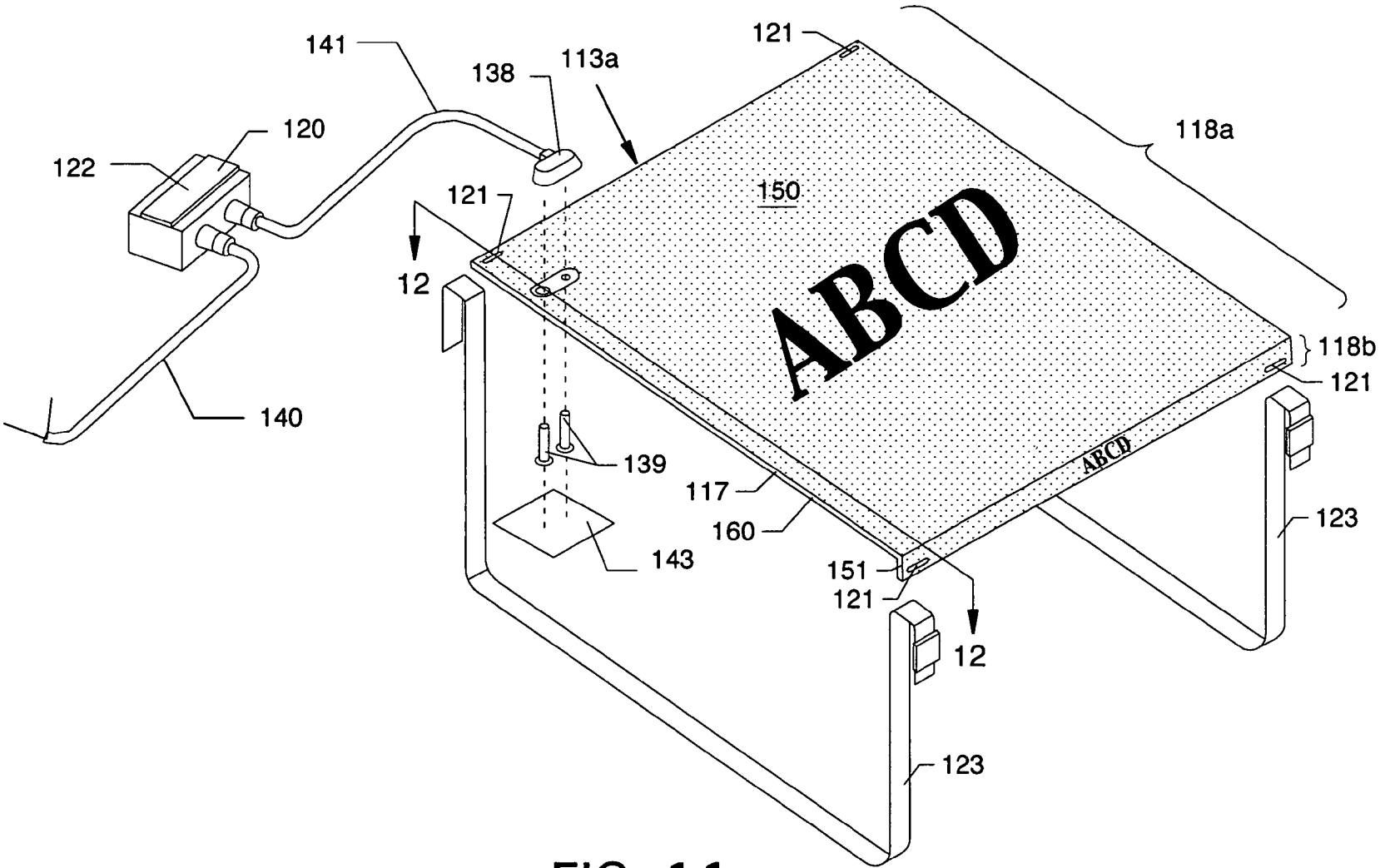
FIG. 11 is an isometric view of the sensing mat and the housing including the alternative embodiment sensor circuit.

FIG. 11 is an isometric top view of the sensor mat 118 and the housing 120 including the alternative embodiment sensor circuit 122 and the electrical connector 138 and bolts or screws 139 for electrical connection of the sensor mat 118 through cable 141 to housing 120 to produce output of the alternative embodiment sensor circuit 122 communicated on toward the lane module 128 (FIG. 10) via the cable 14O. The sensor mat 118 is layered and is held onto the relay takeoff swimming platform 116. The sensor mat 118 includes a generally horizontally oriented portion 118*a* which aligns along and about the generally horizontally oriented planar top of the relay takeoff swimming platform 116 overlooking the swimming pool 114 for adequate and controlled physical contact with all or a major portion of a dry or wet swimmer's feet and a generally vertically oriented portion 118*b* which is contiguous and continuous with and extends downwardly from the generally horizontally oriented portion 118*a* for adequate and controlled physical contact of a portion of a swimmer's wet or dry feet and/or toes, as required. The exterior 150 of the sensor mat 118 includes a textured or otherwise roughened upper surface, preferably formed with a sandpaper-like slip resistant surface to enhance suitable non-slip contact with the dry or wet feet and/or toes or portions thereof of a swimmer. The exterior layer 150 overlies an insulator layer 151 which optionally may be printed with indicia such as a manufacturer's name and/or trademarks and/or an educational institution's name and/or trademarks or the like. In such a printed situation, it is preferred that the upper layer 150 is generally clear so as to allow the optional indicia of the insulator layer 151 to be visible and discernable through the upper layer 150. A polycarbonate perimeter 117 of the sensor mat 118 underlies and carries insulator layer 151. As will be explained in greater detail subsequently, the polycarbonate perimeter 117 turns or folds to continue from the generally horizontally oriented portion 118*a* to the generally vertically oriented portion 118*b*. An insulator layer 160 underlies and is also attached to the polycarbonate perimeter 117. Slots 121 extend through the sensor mat 118 to allow a pair of straps 123 to hold the sensor mat 118 upon the relay takeoff swimming platform 116. Preferably, the housing 120 may be carried by one of the straps of the pair of straps 123 attaching the sensor mat 118 to the relay takeoff swimming platform 116.

Figure 12A:
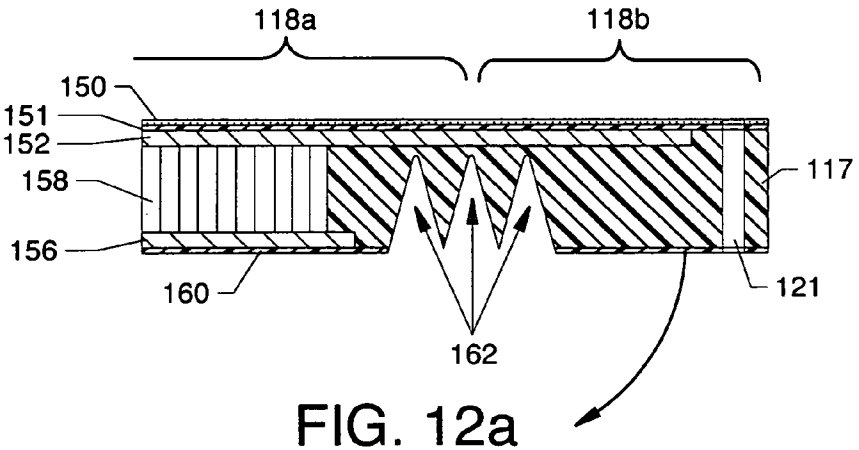
FIG. 12*a* depicts an enlarged cross section view including grooves in a precursor leading to the alternative embodiment sensing mat of FIG. 12 *b;*
Figure 12B:
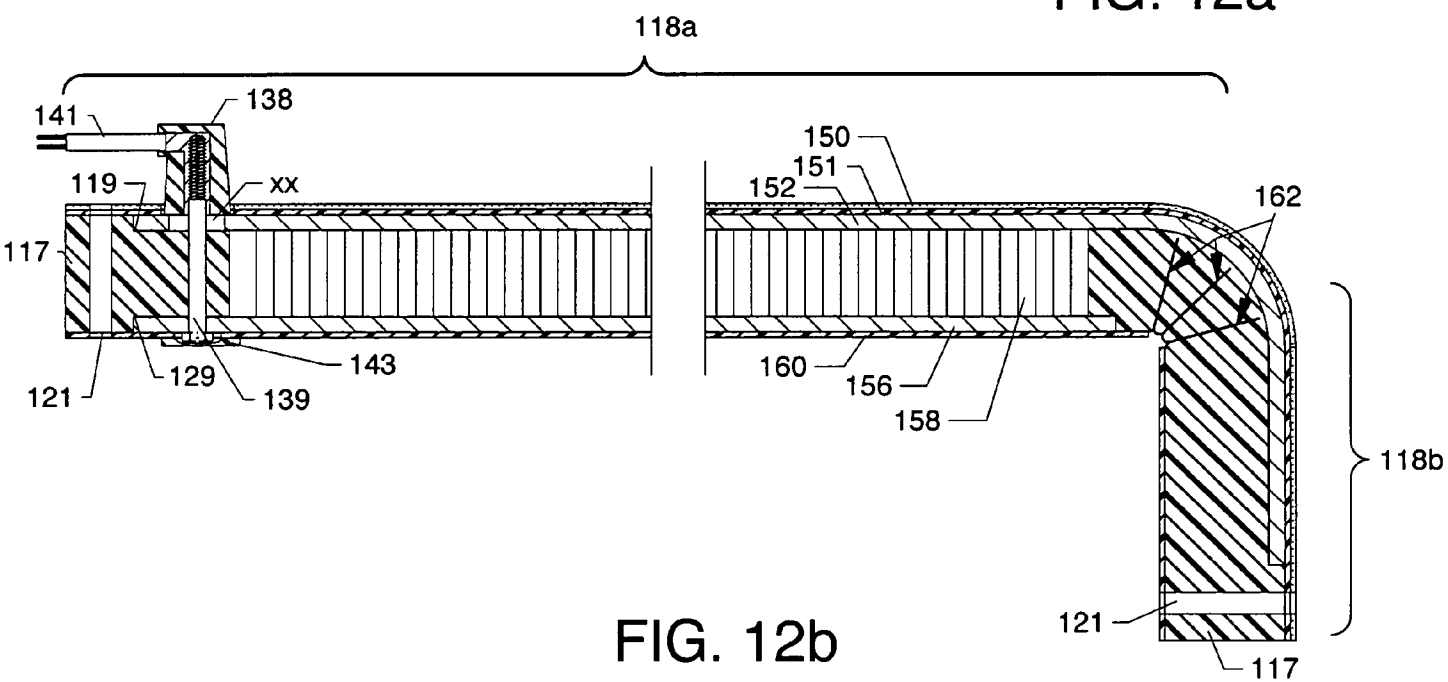
FIG. 12*b* is an enlarged cross section view of the alternative embodiment sensing mat along line 12-12 of FIG. 11 showing the layered construction including alternating electrical conductor and electrical insulator layers along with a folded perimeter.

FIG. 12 is an enlarged cross section view of the sensor mat 118 along line 12-12 of FIG. 11 showing the layered construction including alternating electrical conductor, electrode, and electrical insulator layers suitably fashioned where a suitable adhesive or other bonding means is incorporated (not shown) to bond the conductor, electrode and insulator layers together substantially into a structure which maintains integrity and suitable electrical and physical qualities even when not assuming an entirely planar shape. Sense electrode 152 of sensor mat 118 is preferably aluminum and most preferably aluminum with a thickness of about 0.040 inch in thickness. The sense electrode 152 electrically connects to the alternative embodiment sensor circuit 122 incorporating a charge-transfer touch integrated circuit 154 (shown in detail in FIGS. 14A-14O) which fosters projection of an electric field around a conductive sense electrode 152 central to the sensor mat 118. The charge-transfer touch integrated circuit 154 preferably is a QT9701 B2 IC (available from Quantum Research Group) utilizing a proprietary charge transfer sensing algorithm and including the capability of automatic recalibration. Disruption or change of the electric field about the conductive sense electrode 152 connected to the charge-transfer touch integrated circuit 154 in the alternative embodiment sensor circuit 122 is detected to signal swimmer departure. A conductive shield electrode 156 opposes the conductive sense electrode 152 with an insulative layer 158 disposed therebetween. Preferably, the insulative layer 158 is a polypropylene honeycomb material. The conductive shield electrode 156 in opposition to the conductive sense electrode 152 serves to shield the conductive sense electrode 152 from sensing nuisance touches in the underside region of the relay takeoff swimming platform 116. The conductive shield electrode 156, preferably composed of aluminum, connects to the driven shield of the alternative embodiment sensor circuit 122. An insulator layer 160, preferably polycarbonate, is included on the underside of the conductive shield electrode 156 to insulate the conductive shield electrode 156 from a mounting surface such as provided by the relay takeoff swimming platform 116. Insulator layer 151 is provided between the conductive sense electrode 152 and the exterior layer 150 to carry any optional printed indicia, further insulate the conductive sense electrode 152, and to provide additional protection of the conductive sense electrode 152. In the alternative, though less desirably in this alternative embodiment, composite material can be incorporated into use in lieu of the conductive sense electrode 152, the insulative layer 158, and the conductive shield electrode 156. An ACM (aluminum composite material), such as ALUCOBOND® or Alumalite™ includes a top layer of aluminum, a bottom layer of aluminum, and a nonconductive plastic layer interposed and affixed therebetween, thereby forming a laminate. The top layer of aluminum corresponds to the conductive sense electrode 152, the nonconductive plastic layer corresponds to the insulative layer 158, the bottom aluminum layer corresponds to the conductive shield electrode 156, and, if incorporated, a layer of nonconductive paint applied to the upper surface of the top layer of aluminum corresponds to the insulator layer 151. The use of such a pre-formed laminate is potentially beneficial in decreasing fabrication time.

The more preferred sensor mat 118 and the insulative perimeter 117 included therein may be further understood by review of the cross sectional view of FIG. 12 and consideration of how a preferred sensor mat 118 may be prepared. The insulative perimeter 117 preferably originates as a sheet of polycarbonate. First, the polycarbonate sheet is cut to the intended combined size of both the horizontally oriented portion 118*a* and the vertically oriented portion 118*b* of the sensor mat 118. Preferably, the polycarbonate sheet has a thickness of about ⅜ inch and more preferably is a ⅜ inch polycarbonate sheet having dimensions of about 34 inches by about 23 inches. Next, within the horizontally oriented portion 118*a* of the polycarbonate sheet becoming the insulative perimeter 117, a center portion is removed, thereby resulting in a frame-like structure of polycarbonate with an opening for holding and receiving the polypropylene honeycomb insulative layer 158. Preferably, the insulative layer 158 of polypropylene honeycomb, which is preferably about 0.29 inch thick, and the opening cut into the frame-like structure of the polycarbonate perimeter 117 are like sized and most preferably about 29.5 inches by about 21.0 inches. The top face of the polycarbonate sheet, adjacent the opening for receiving the polypropylene honeycomb insulative layer 158 is milled to a depth corresponding to the thickness of the sense electrode 152. Preferably, the sense electrode 152 is formed of aluminum and most preferably aluminum of about 0.040 inch in thickness and thus a corresponding milling results in a channel 119 about 0.040 inch in depth. Most preferably, the sense electrode 152 is about 32.75 inches by about 22.00 inches. The boundaries of the channel 119 are generally centered on the polycarbonate perimeter 117 in the milling step and, therefore, undisturbed polycarbonate on the top surface is preferably about 0.500 inch on the sides and about 0.625 inch on each of the ends. Into this frame-like polycarbonate perimeter 117 is inserted the polypropylene honeycomb insulative layer 158 and into the channel 119 is inserted the sense electrode 152. Next, the partially completed structure is inverted and the bottom side of the polycarbonate perimeter 117 is milled to accept the shield electrode 156. The preferred shield electrode 156 is also formed of 0.040 inch thick aluminum; however, it is shorter than the sense electrode 152, preferably about 29.25 inches by about 22.00 inches. The preferred bottom milled channel 129 is therefore about 0.040 inch thick and mostly coincident with the top channel 119, except that it does not extend into the vertically oriented portion 118*b* of the sensor mat 118 and is positioned only within the horizontally oriented portion 118*a*. The shield electrode 156 is laminated into this bottom milled channel 129. Next, the bottom insulator layer 160, preferably about 0.060 inch in thickness, is laminated to the bottom of the assembly. Next, still working upon the bottom side, a series of three parallel and adjacent grooves 162 are milled from side to side coincident with the transition between the horizontally oriented portion 118*a* and the vertically oriented portion 118*b* of the sensor mat 118. The three grooves 162 extend through the bottom insulator layer 160 and nearly through the polycarbonate sheet perimeter 117 but not into nor through the sense electrode 152. Preferably, each of the three grooves 162 extend through the bottom insulator layer 160 and into the polycarbonate sheet perimeter 117 and terminate about 0.020 inch from the boundary between the polycarbonate sheet perimeter 117 and the conductive sense electrode 152, as depicted in FIG. 12*a*. Each of the three grooves 162 are generally V-shaped. With respect to each groove 162, the two sides are inclined at about 15 degrees and therefore form an angle of about 30 degrees to each other within each groove. The slots 121 are milled through the bottom insulator layer 160 and the polycarbonate perimeter 117. Additionally, milling is performed to accommodate the electrical connection 138 so as to provide one through bolt or screw 139 in contact with the sense electrode 152, precluding contact with shield electrode 156 and also milling is performed to provide the other through bolt or screw 139 contact with the shield electrode 156, precluding contact with the sense electrode 152. Next, the insulator layer 151 is applied above the sense electrode 152. Preferably, printed indicia are present on the insulator layer 151, as well as a release sheet protecting a self-adhesive layer. The release sheet is carefully removed and then the printed indicia carefully aligned with the top of the assembly, prior to application to the assembly. Subsequent to application, the self-adhesive insulator layer 151 is trimmed to accommodate edges and slots 121, as well as to accommodate electrical connection 138. Next, the exterior layer 150 is applied over the insulator layer 151 and similarly trimmed. Alternatively, trimming of the insulator layer 151 and exterior layer 150 may be combined. Next, the vertically oriented portion 118*b* of sensor mat 118 is oriented with respect to the horizontally oriented portion 118*a* of the sensor mat 118. A narrow bead of adhesive is applied into each of the three grooves 162. When the assembly is bent at the junction of horizontally oriented portion 118*a* and vertically oriented portion 118*b*, slightly past 90 degrees, and held for a short period of time, and then released, an angle of about 90 degrees is maintained therebetween, due in part to the sense electrode 152 and in part to the adhesive in the grooves 162. The resulting sensor mat 118, in part due to the sealed relationships of the polycarbonate perimeter 117, serves two purposes. First, it minimizes the effects of fringing of the electric field, and second, in combination with the exterior layer 150 and printed insulator layer 151, it also prevents a drop of water from shorting (or electrically connecting) the shield electrode 156 to the sense electrode 152. Such an undesirable shorting could happen at the edge of the sensor mat 118 panel if the perimeter 117 and channel 119 therein were not present. Also note the two slots 121 at either end of the sensor mat 118, which hold straps 123 used to secure the sensor mat 118 to the top of a starting block. The slots 121 are positioned out of contact with the shield electrode 156 and the sense electrode 152, thereby insulating and isolating straps 123 from the electrodes 152 and 156 of the sensor mat 118. This arrangement also ensures that when wet, neither strap 123 shorts the sensor mat 118 to metal block top. The electronic components of the alternative embodiment sensor circuit 122 are enclosed or contained in housing 120. Preferably, housing 120 is clipped or otherwise attached to one of the straps 123. Connection of the sensor mat 118 to the housing 120 is by a shielded cable 141.

Figure 13:
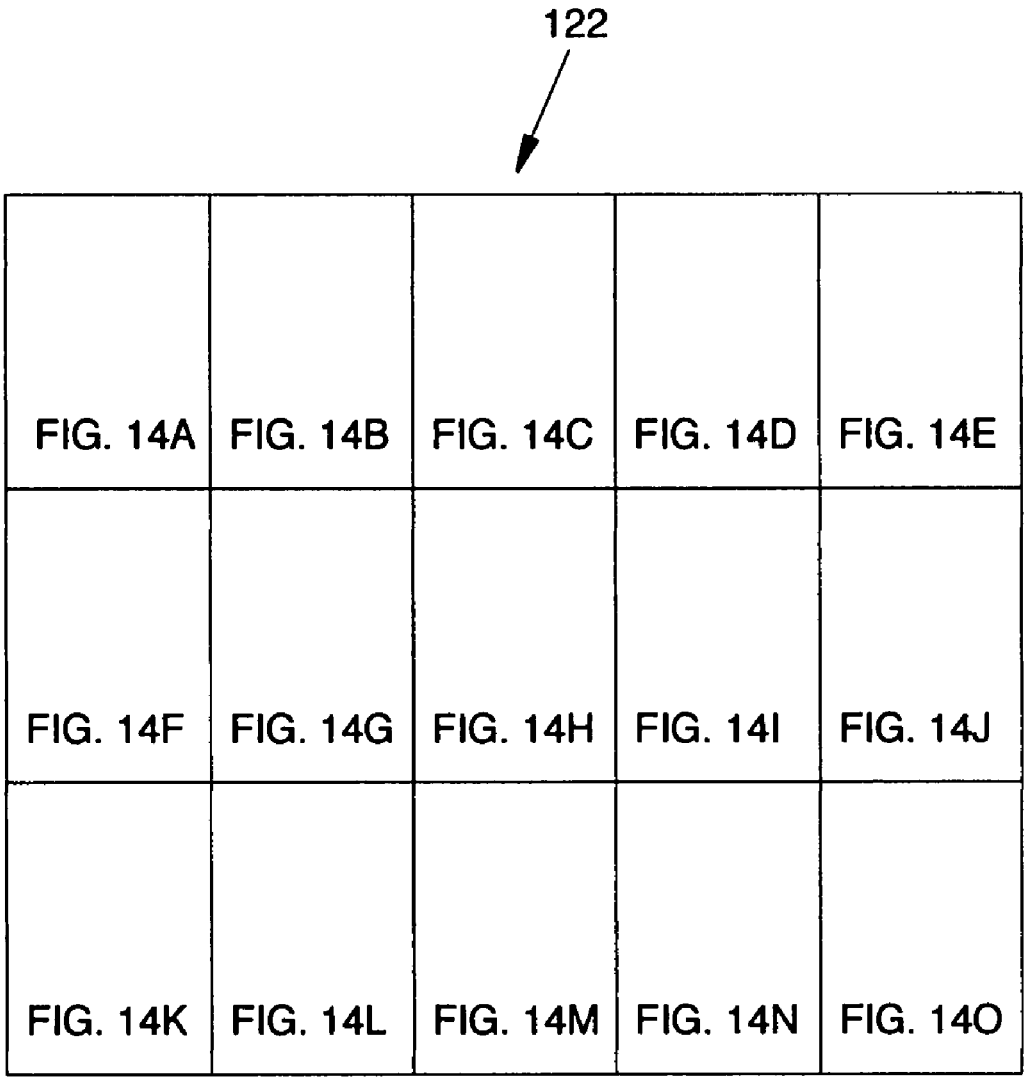
FIG. 13 shows the alignment of FIGS. 14A-14O with respect to each other.
Figure 14A:
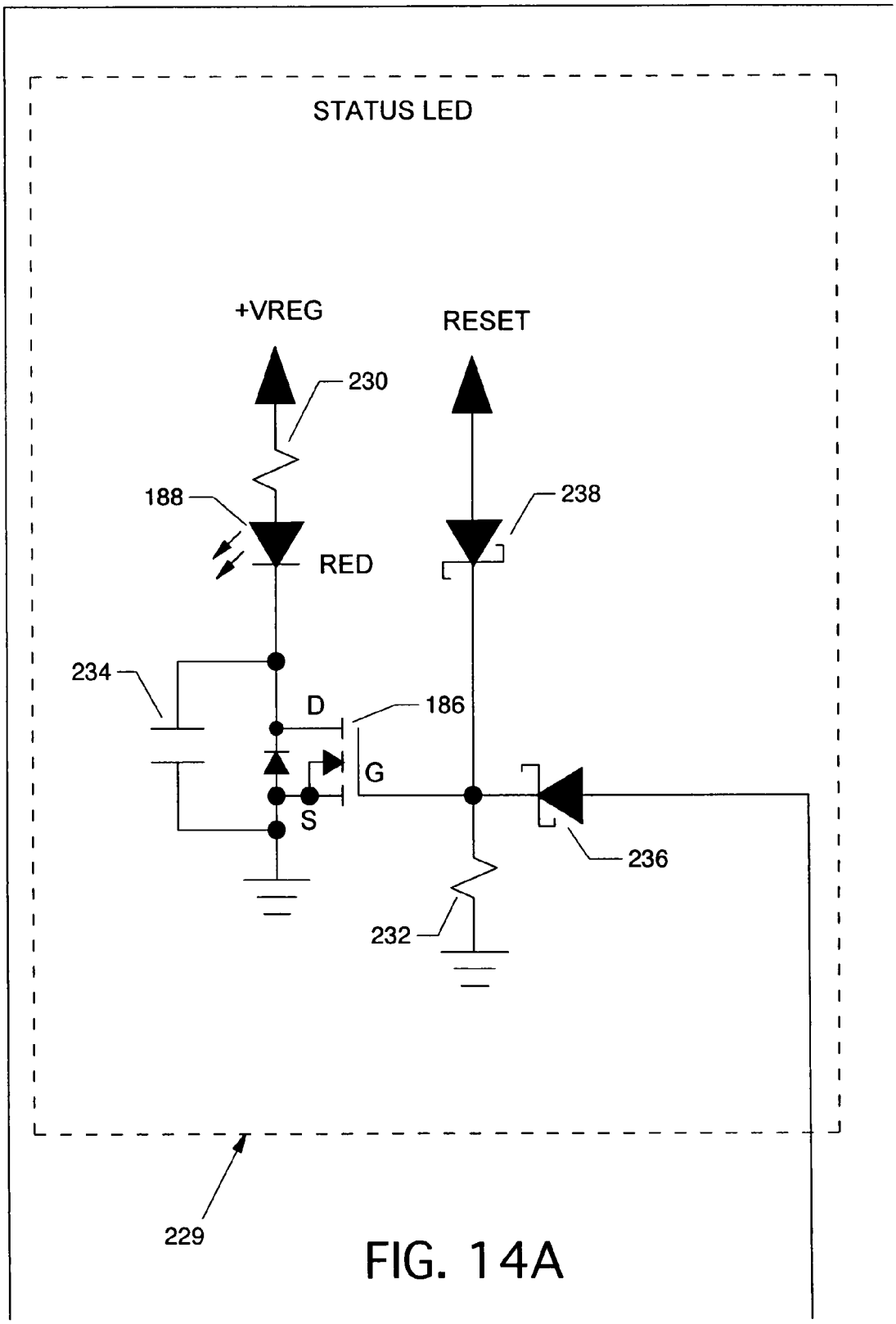
FIGS. 14A-14O, when aligned as shown by FIG. 13, illustrate the circuit schematic diagram for the alternative embodiment sensor circuit.
Figure 14B:
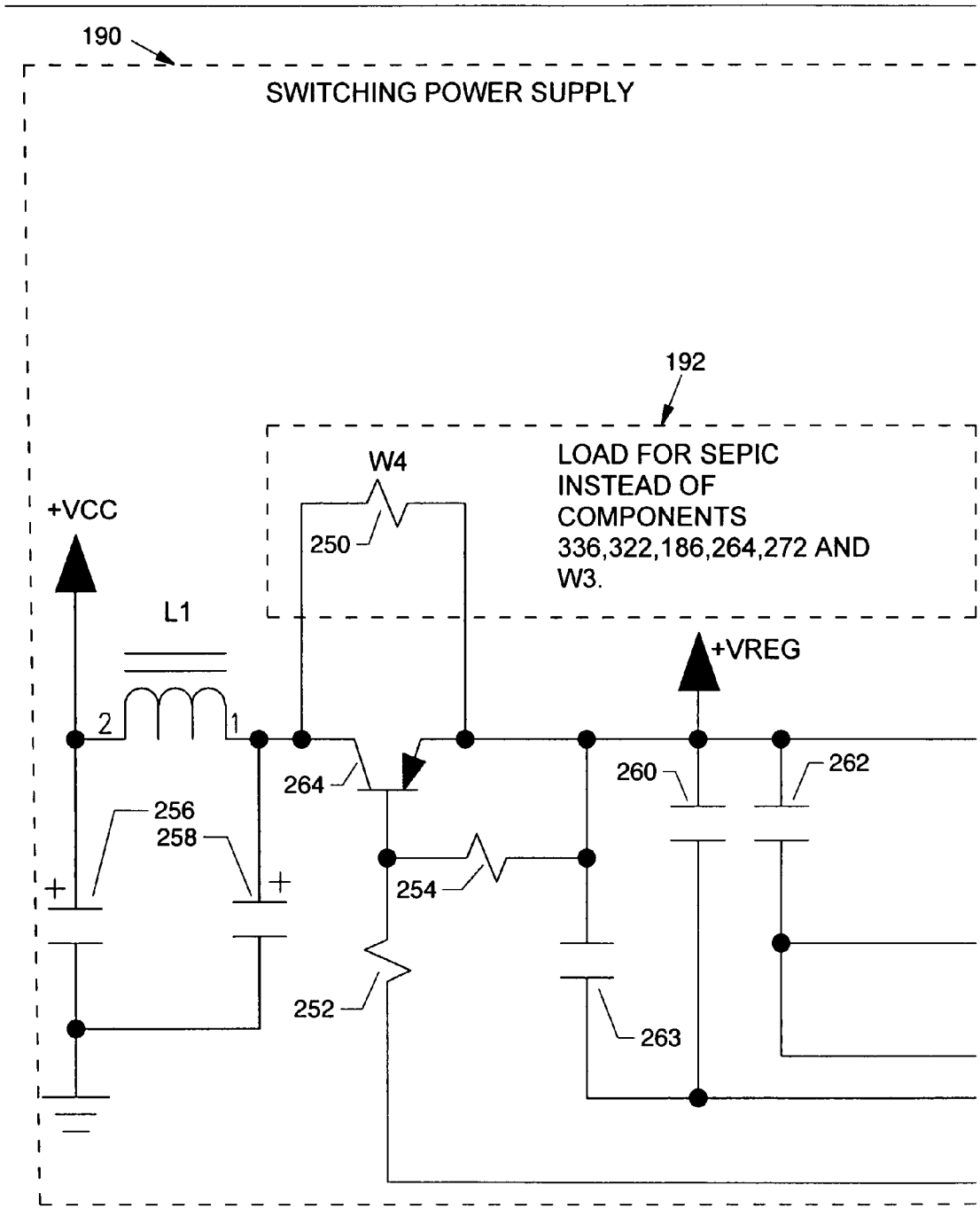
Figure 14C:
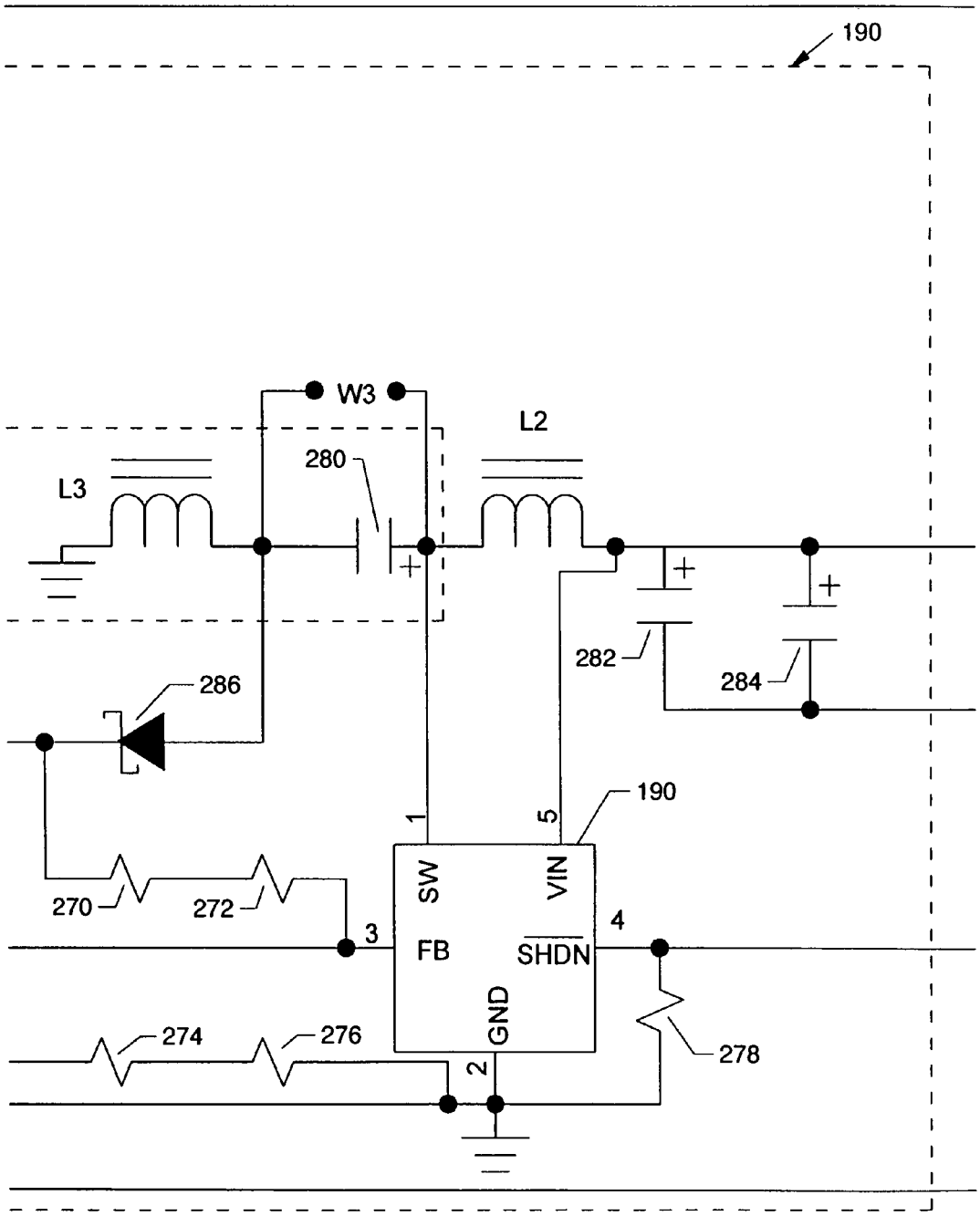
Figure 14D:
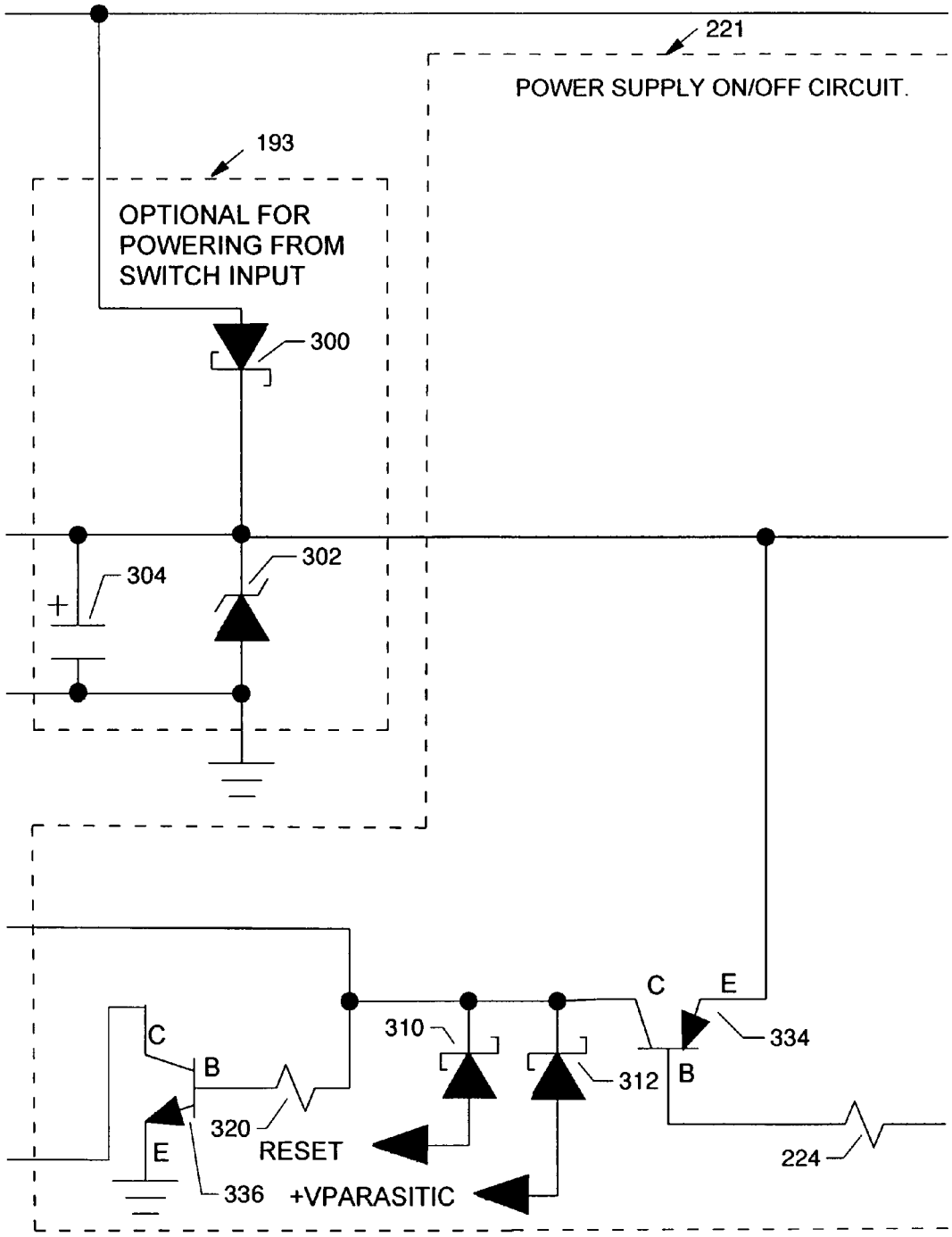
Figure 14E:
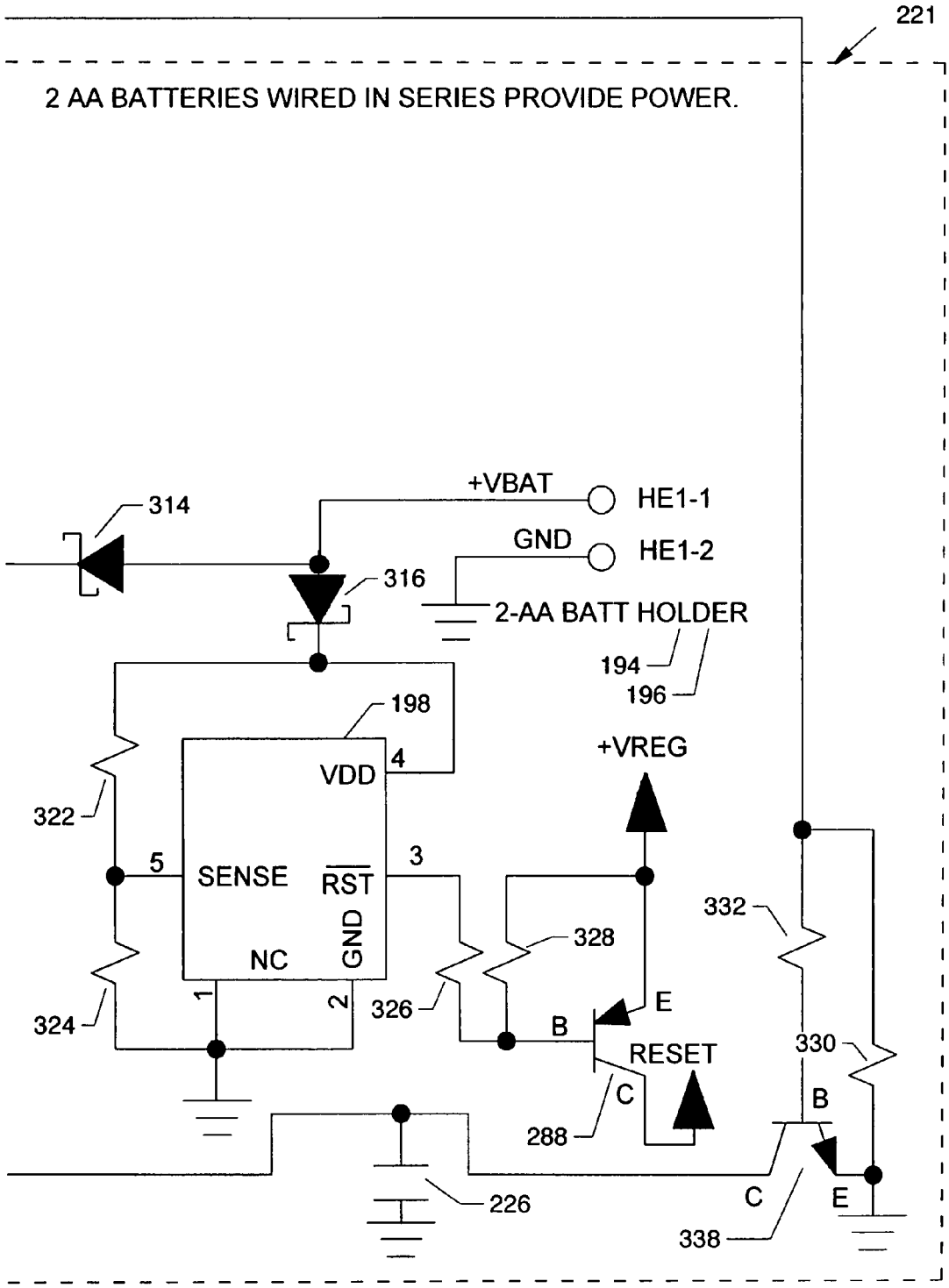
Figure 14F:
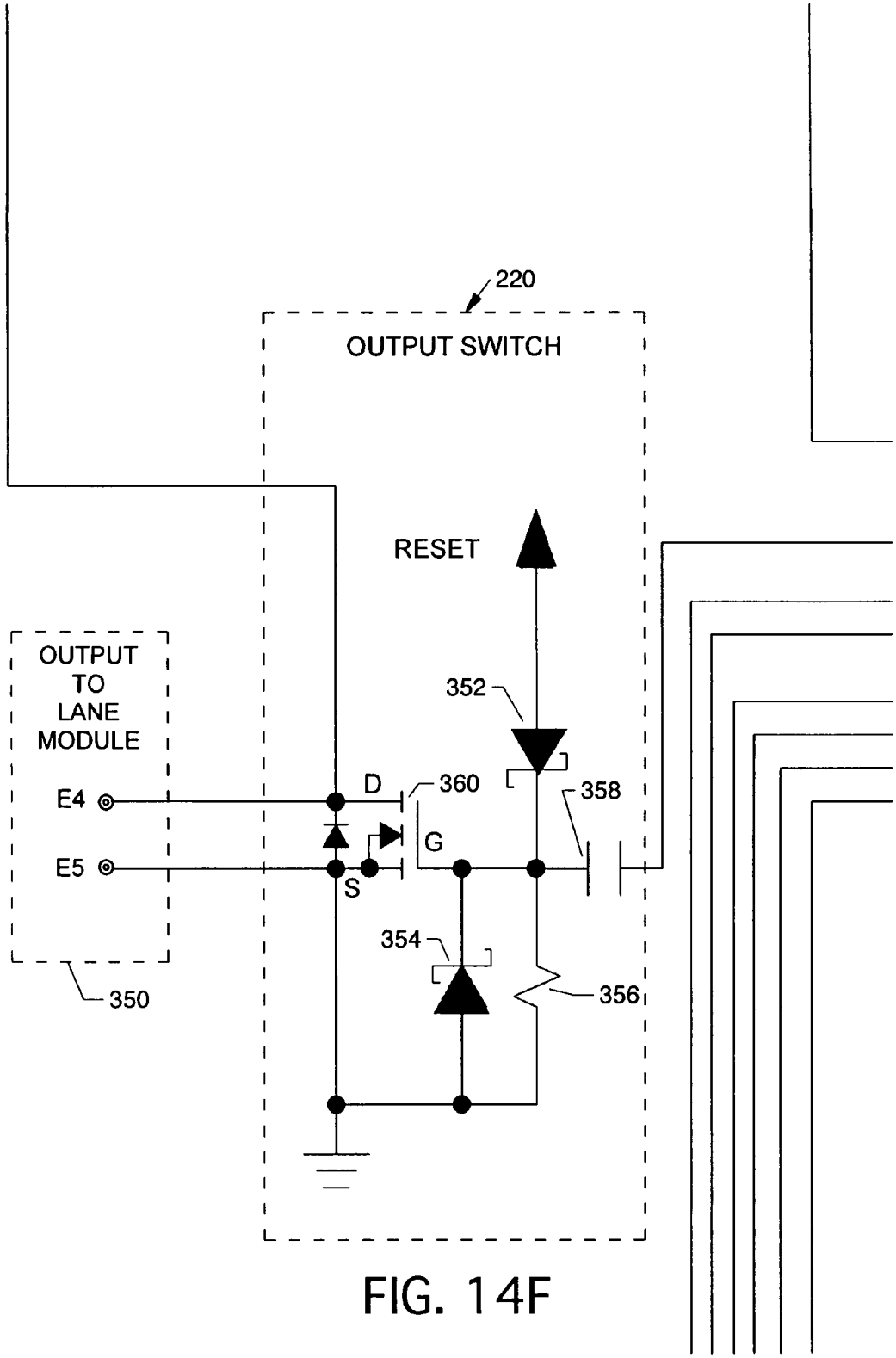
Figure 14G:
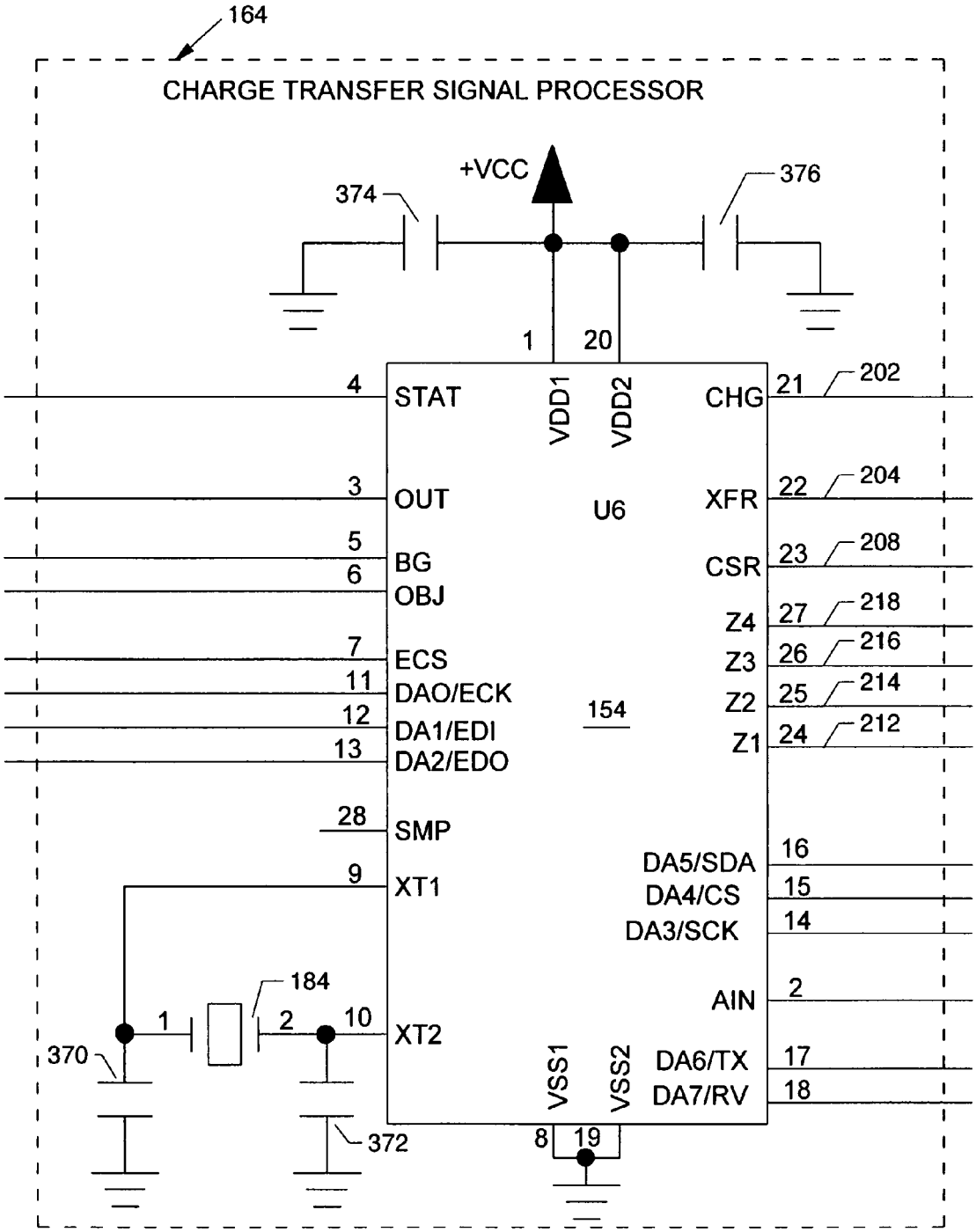
Figure 14H:
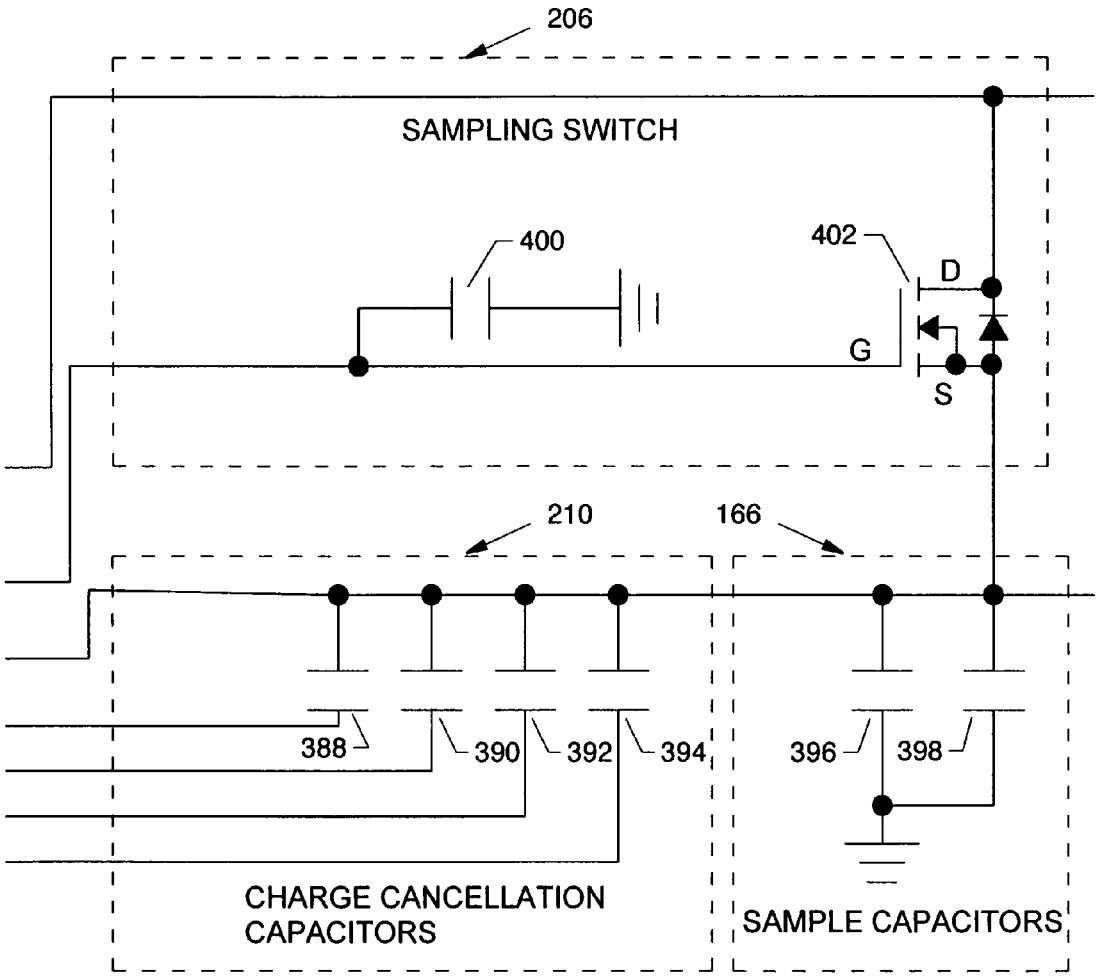

FIGS. 14A-14O, when aligned as shown in FIG. 13, illustrates the alternative embodiment sensor circuit 122 incorporated for detection of the variance of the capacitence of the sensor mat 118. Central to the operation of the alternative embodiment sensor circuit 122 is a capacitive monitor circuit 164 shown in FIG. 14G, which connects, as previously described, to the conductive sense electrode 152 and to the conductive shield electrode 156, as shown on FIG. 14J. The capacitive monitor circuit 164 includes the charge-transfer touch integrated circuit 154 and sampling capacitors 166, as shown in FIG. 14H, operably connected with the charge-transfer touch integrated circuit 154. The value of the sampling capacitors 166 can be changed as required to provide proper sensitivity for a given capacitance across the sensor mat 118, such as between the conductive sense electrode 152 and the conductive shield electrode 156. Preferably, the charge-transfer touch integrated circuit 154 includes a model QT9701B2 IC available from Quantum Research Group. This component incorporates an automatic calibration feature that can be configured so as to automatically compensate for differences in the sensing environment at the sensor mat 118. The overall range of capacitance which may be monitored by the charge-transfer touch integrated circuit 154 is very large, but the capacitance changes of interest in sensing a swimmer leave event (i.e., the change in capacitance when a swimmer standing upon the sensor mat 118 exits from the sensor mat 118) are very small compared to this very large overall range. To overcome this challenge, the charge-transfer touch integrated circuit 154 senses or "sees" or monitors only a small portion of the possible very large monitor range at any given time. In particular, in this alternative embodiment, the QT9701B2 IC charge-transfer touch integrated circuit 154 component is configured so that anytime the signal is not "in view" for more than a pre-selected time interval, preferably more than about a 0.2 second time interval, the charge-transfer touch integrated circuit 154 will automatically recalibrate and thereby bring the capacitance signal back "into view." Using this automatic recalibration feature, the preferred charge-transfer touch integrated circuit 154 allows the user to configure, and thereby select, the conditions which cause the output to become active. Further, the signal threshold at which the output becomes active is programmable and this programmable signal threshold feature may be programmed relative to the situation in which it is being applied. The charge-transfer touch integrated circuit 154 can be configured to activate the output, either when the signal exceeds the threshold or when it drops below the threshold. In particular, the configuration used with the alternative embodiment relay takeoff platform system 109 of the present invention causes the output to activate when the signal drops below the selected threshold. Another feature of the charge-transfer touch integrated circuit 154 that can be turned on or off is drift compensation. The drift compensation feature allows the threshold to be moved and thereby track slow changes in the signal being monitored. Such a feature ensures that slow signal drift will not cause the output to trip erroneously. The signal drift feature is turned on in the capacitive relay takeoff platform sensor system 109, this alternative embodiment of the present invention.

The sensor circuit 122 includes the following sequence of events when in use. When the sensor mat 118 upon the relay takeoff platform 116 is first powered up by plugging it into a lane module 128, the charge-transfer touch integrated circuit 154 performs a power on calibration, thereby compensating for any background capacitance and bringing the capacitance signal into "view." When a first swimmer steps onto the sensor mat 118 atop the relay takeoff swimming platform 116, the capacitance signal will exceed the upper level of the window being monitored by the charge-transfer touch integrated circuit 154. After a pre-selected time interval, preferably about 0.2 second, the charge-transfer touch integrated circuit 154 automatically recalibrates so as to compensate for the presence of the first swimmer, and thereby repositions its monitoring window to again bring the capacitance signal back into "view." When the first swimmer leaves the relay takeoff swimming platform 116, the capacitance signal will drop below the threshold, triggering the output. Preferably, the pre-selected automatic recalibration interval is about 0.2 second. Additionally, the event of the first swimmer leaving the sensor mat 118 on the relay takeoff swimming platform 116 will also drop the capacitance below the lower level of the window being monitored, and after the pre-selected automatic recalibration time interval, preferably about 0.2 second, another recalibration will again take place so as to reposition the window being monitored. In this manner, the charge-transfer touch integrated circuit 154 automatically recalibrates to each swimmer stepping onto and diving off of the sensor mat 118, and compensates for any changes in the sensing environment.

The sensor circuit 122 may be further understood by considering the functions of certain components parts thereof. Serial EEPROM circuit 168 is used to store the configuration setting mentioned above, among others. This configuration setting storage is for the QT9701B2. The serial digital-to-analog converter 170 is used in the automatic calibration function mentioned above. The charge-transfer touch integrated circuit 154 writes data to the serial digital-to-analog converter 170 to generate the charge offset signal data for the QT9701B2, which data is subtracted from the raw signal by Op Amp with gain circuit 172. Op Amp with gain circuit 172 also serves as a gain stage for the raw signal. RS-232 transceiver 174 is used for connecting the charge-transfer touch integrated circuit 154 to a PC 176, thereby facilitating configuring the charge-transfer touch integrated circuit 154. A parasitic power circuit 178 also draws power for the RS-232 transceiver 174 through the RS-232 lines to the PC 176, such that battery power is not wasted during normal operation. Loads 180 and 182 can be loads for TTL level communications by applying jumpers instead of the charge-transfer touch integrated circuit 154 if a logic level programming device (not shown) is used in manufacturing production. Crystal 184 serves as a clocking source for the charge-transfer touch integrated circuit 154, which is microprocessor based. FET 186 controls the blinking of the LED 188, which indicates status of the sensor circuit. In particular, when LED 188 stays continuously lit, the batteries are low or weak, when LED 188 blinks on and off, the sensor circuit is operating normally, and when a swimmer departure event occurs, the normal operation on and off blinking is temporarily altered to an extended or long "on" blink and then returns to regular on and off blinking. Switching power supply 190 is also present. There are loading options to make the sensor circuit 122 function as a buck/boost SEPIC circuit 192 (for powering from optional circuit 193, as shown on FIG. 14D, which may be above or below 5V), or as a standard boost regulator for operating from batteries 194 and 196, preferably AA batteries, connected in series. A voltage monitor 198 holds the circuit in a "RESET" 200 when the battery voltage drops below 1.62V.

The workings of the circuit may be further understood and appreciated in view of the following theory of operation of the circuit. The charge-transfer touch integrated circuit 154 sends a series of pulses to the sense electrode 152 via the "CHG" pin 202. Following the series of pulses, the charge-transfer touch integrated circuit 154 activates the "XFR" pin 204, turning on the sampling switch 206 and transferring the charge accumulated on the sense electrode 152 to the sampling capacitors 166. Op Amp with gain circuit 172 amplifies the signal present on the sampling capacitors 166 and presents this signal to an analog input on Op-Amp with gain circuit 172. After a programmable number of charge/transfer cycles, the charge-transfer touch integrated circuit 154 reads in the output of Op Amp with gain circuit 172, which is the raw signal input representing the capacitance, or electric field coupling at the sense electrode 152. The charge-transfer touch integrated circuit 154 then brings "CSR" pin 208 low to zero out the charge on the sampling capacitors 166 in preparation for a new charge/transfer cycle. There are also two methods for charge cancellation provided by the charge-transfer touch integrated circuit 154. The charge cancellation capacitors 210 can be activated by the Z1-Z4 pins 212, 214, 216 and 218, respectively, in order to subtract accumulated charge from sampling capacitors 166 so as to bring the signal in range. The serial digital-to-analog converter 170 allows the charge-transfer touch integrated circuit 154 to "servo" the output of the Op Amp with gain circuit 172 by generating a signal to be subtracted from the signal on the sampling capacitors 166. As explained above, the charge-transfer touch integrated circuit 154 is configured to output a logic '1' when the signal drops below a programmable threshold. The output switch circuit 220 is capacitively coupled in order to convert this output to a pulse, the length of which is determined by the RC network 222. The output FET must only "close" momentarily so that power on/off circuit 221 on FIGS. 14D and 14E does not shut the circuit down when a loss of switch input voltage is briefly present. Resistor 224 and capacitor 226 form an RC combination which serve to allow the power to remain on for a time period that is longer than the output pulse width while no switch input voltage is present (i.e., it implements a "delayed off" function). While it is recognized that there may be alternative ways of programming the basic functionality of the particular circuit shown in FIGS. 14A-14O to accomplish the sensing of a swimmer leaving the sensor mat 118, the underlying new concept of the alternative embodiment capacitive relay takeoff swimming platform sensor system 109 is to sense and detect a sudden alteration of capacitance corresponding to each departure of a swimmer from the sensor mat 118 upon relay takeoff platform 116. Although the charge transfer method of capacitive sensing used by the particular charge-transfer touch integrated circuit 154 of Quantum Research (manufacturer of model QT9701B1 IC.) was known prior to implementation in this alternative embodiment of the present invention, the use of charge-transfer touch integrated circuit 154, in combination with and to measure the capacitance of the particular sensor mat 118 with sense electrode 152, as described herein, is believed to be both novel and non-obvious. When a swimmer stands upon sensor mat 118 on the relay takeoff swimming platform 116, then capacitance is increased. When the swimmer leaves the sensor mat 118 on the relay takeoff swimming platform 116, the charge-transfer touch integrated circuit 154 detects the resulting decrease in capacitance and signals the occurrence of the swimmer leaving event. The shield electrode 156 of the sensor mat 118 on the relay takeoff swimming platform 116 prevents the charge-transfer touch integrated circuit 154 from "seeing" anything that is underneath the sensor mat 118. This is important and significant given that the starting blocks or relay takeoff swimming platforms 116 upon which the sensor mat 118 is mounted may be of various materials with differing effects on the signal measurement. Thus, the same basic relay equipment may be moved about and used in events at different swimming pool locations to promote economic efficiency. The shield electrode 156 also presents a very large "background" capacitance that is always present, and much larger than the change in capacitance that must be detected, which is why the "windowing" or "servoing" explained earlier is significant in this new alternative embodiment.

The battery circuit preferably employs two batteries 194 and 196, preferably AA batteries, wired in series. The issuing of a "RESET" 200 signal holds the circuit in an "ON" state, but disables the output so as to prevent spurious or undependable outputs that occasionally may occur when the voltage is below the pre-selected voltage for dependable operation. This provides a visual indication of proper or improper operation. In particular, a low battery condition activates the "RESET" 200 signal and holds the LED 188 in "ON."

Mode of Operation

Reference to FIGS. 14A-14O, the description thereof, and the following, with occasional reference to other figures, best illustrates the mode of operation of the capacitive relay takeoff swimming platform sensor system 109.

When a swimmer is on the relay takeoff swimming platform 116, the capacitive field about the sensor mat 118, and especially the capacitive field about the region overlying the conductive sense electrode 152, is influenced by the body of the swimmer and, as such, is detected and referenced by the charge-transfer touch integrated circuit 154. The output of the charge-transfer touch integrated circuit 154 is low when the swimmer is in physical contact with the sensor mat 118, whereby the capacitance of the sensor mat 118 is at a first level. When the swimmer departs the relay takeoff swimming platform 116, the capacitance of the sensor mat 118 is altered and such change in capacitance to a second level is detected. The change in capacitance is detected by the charge-transfer touch integrated circuit 154, which drives the output high.

Figure 14I:
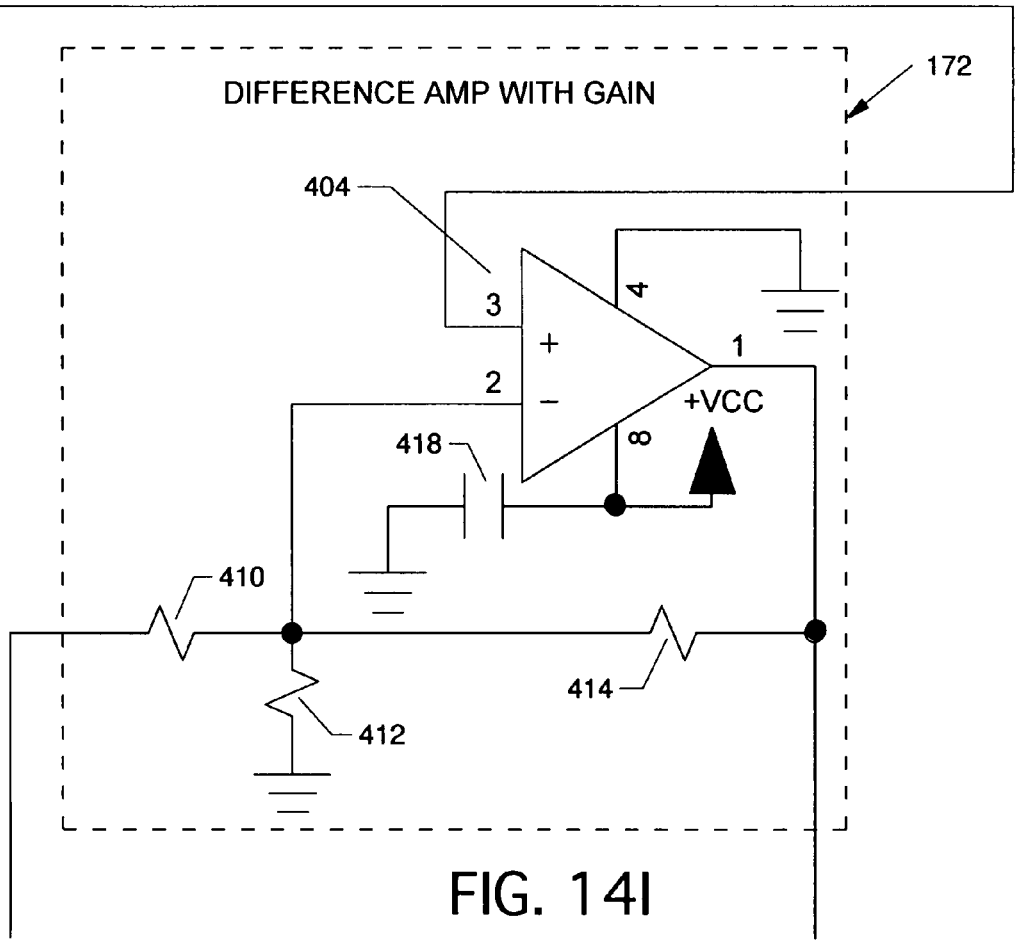
Figure 14J:
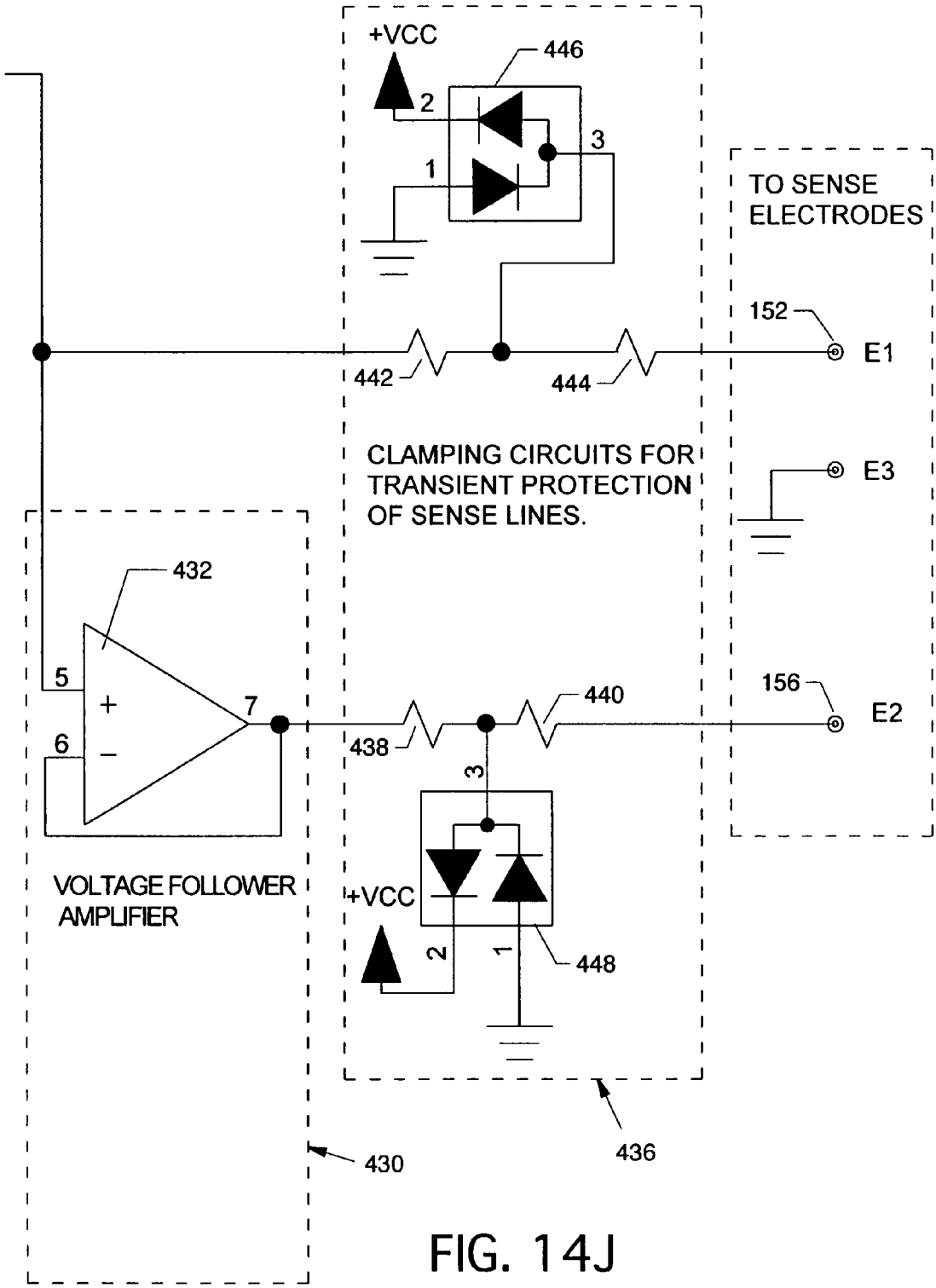
Figure 14K:
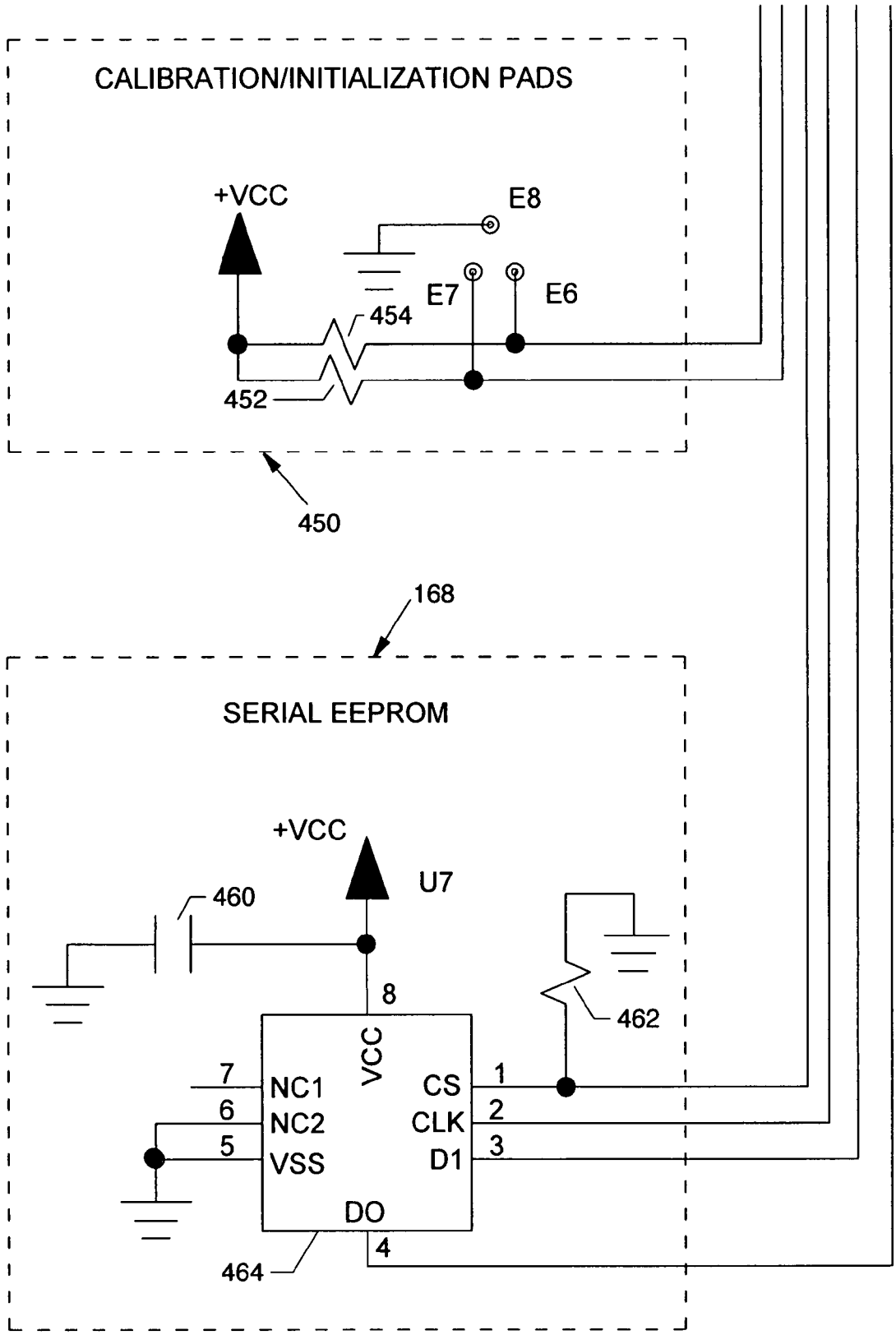
Figure 14L:
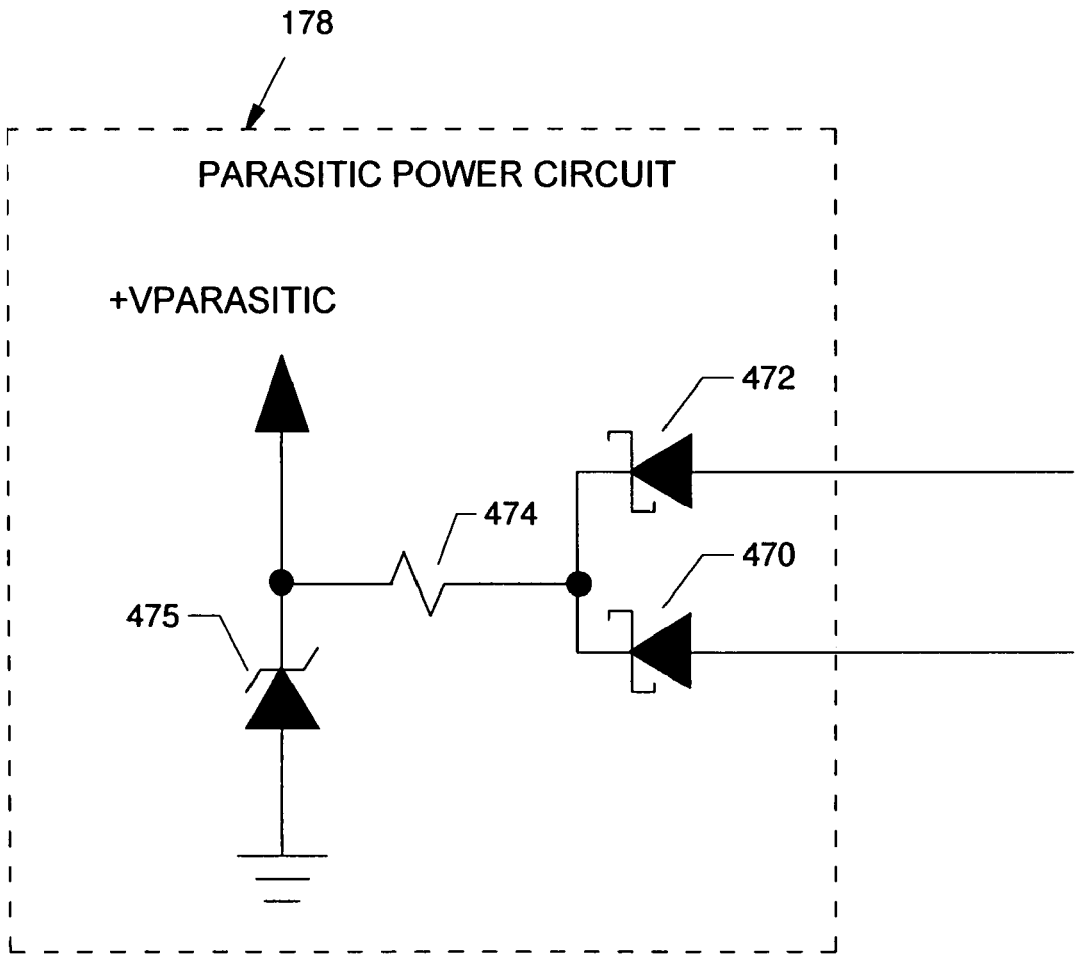
Figure 14M:
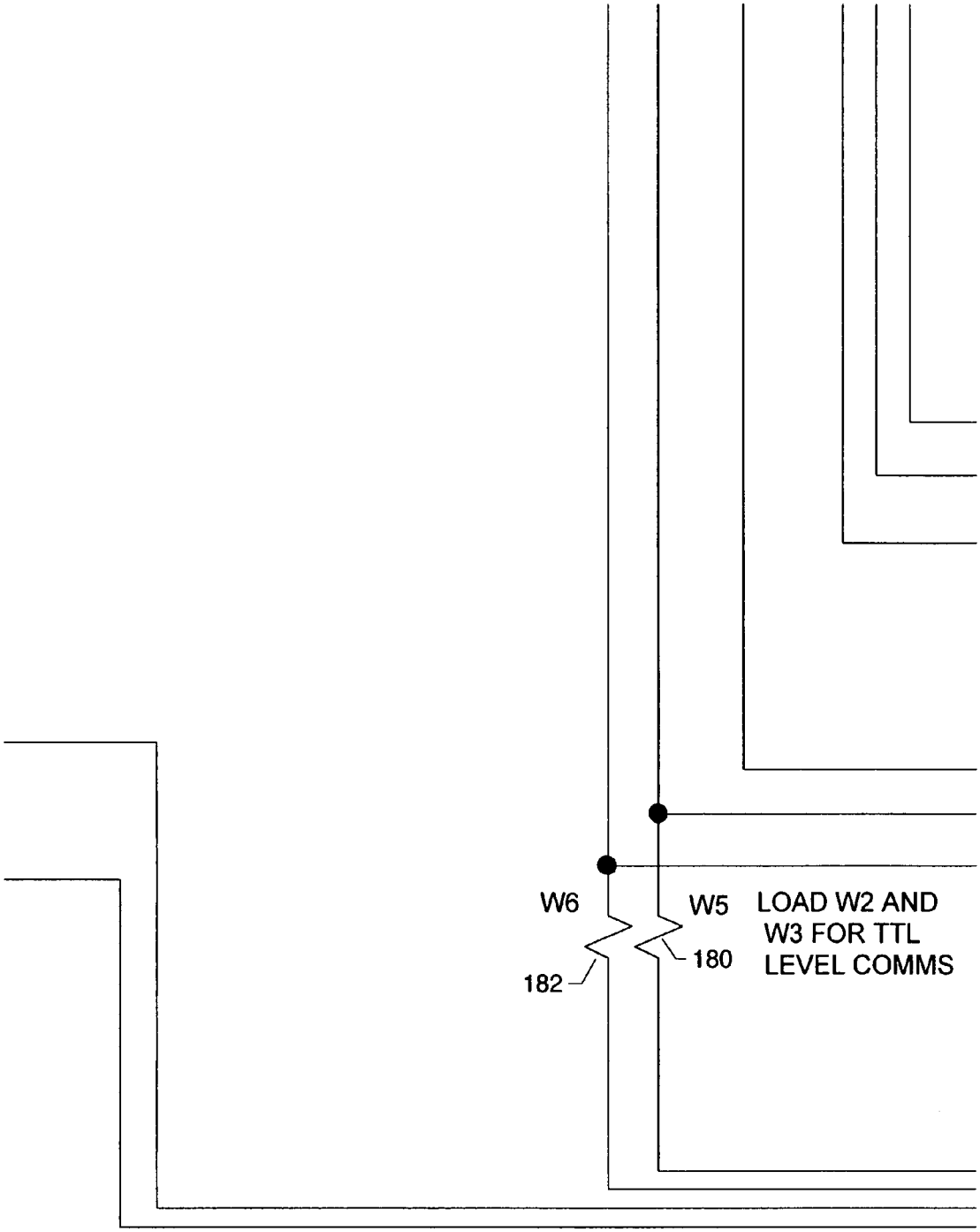
Figure 14N:
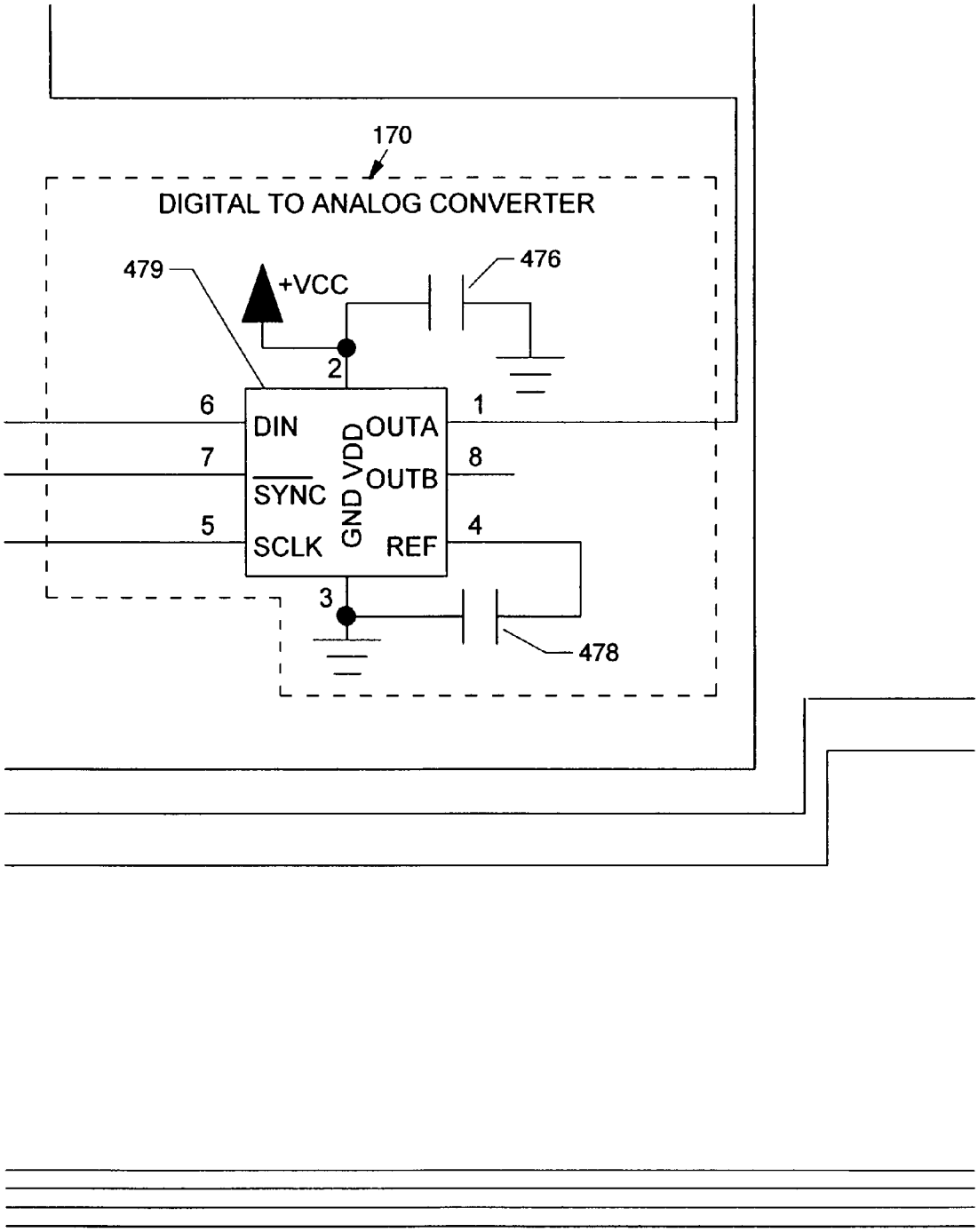
Figure 140:
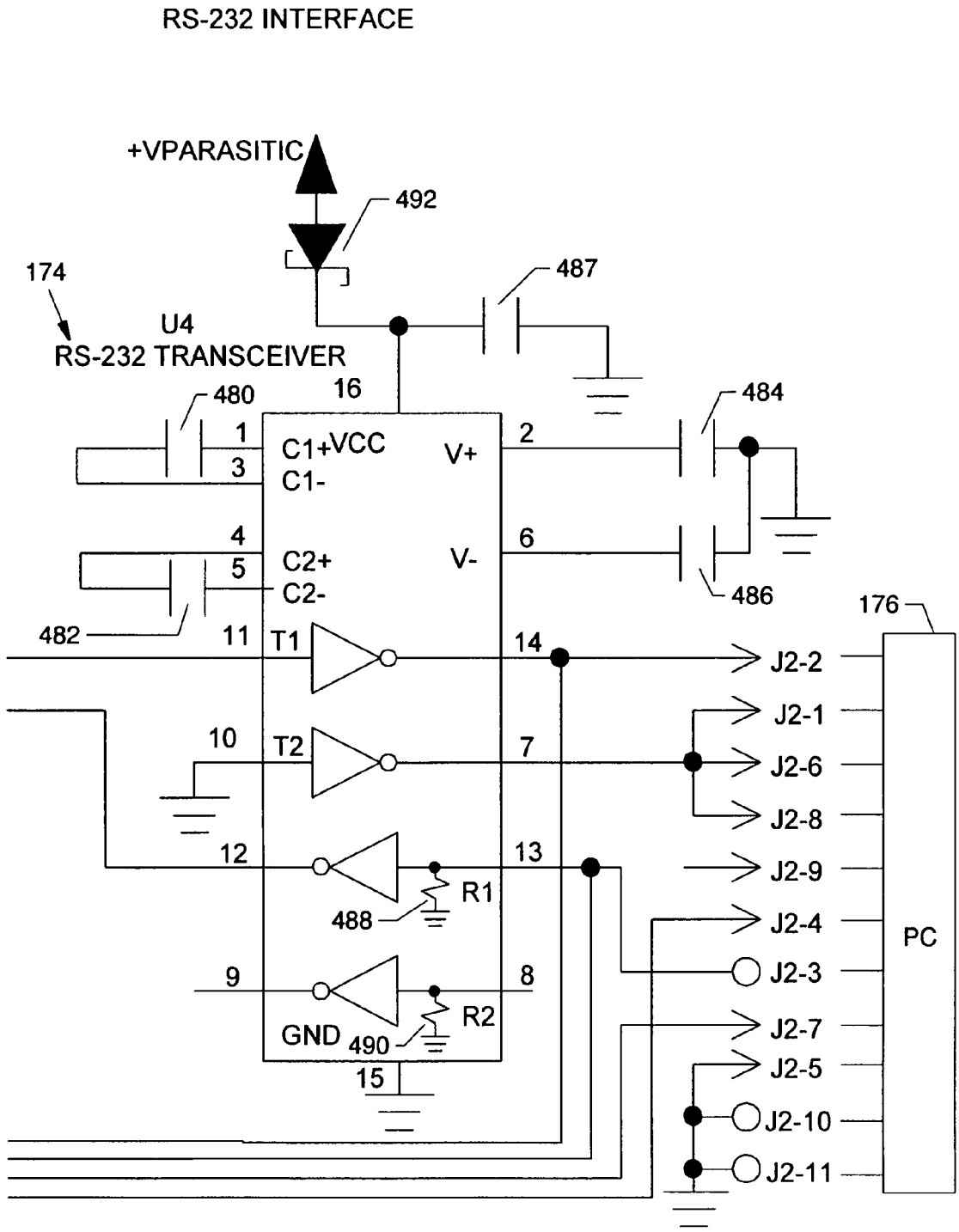

Additional components of the circuit may be noted as follows. In FIG. 14A, a resistor 230 is connected to LED 188. Preferably, the LED 188 is red in color. A second resistor 232 is present in the circuit and also is preferably 10K ohms. A capacitor 234 is operably connected. Two schottky diodes 236 and 238 are also operably connected. The status LED 229 portion of the circuit, shown in FIG. 14A, provides an indication of proper operation. When batteries 194 and 196 are low on power, the "RESET" signal is activated and the LED 188 stays lit. In FIG. 14B and bridging into FIG. 14C is shown the switching power supply 190 portion of the circuit. As previously noted, this circuit can function on battery, via a standard boost converter, or as SEPIC circuit 192 circuit indicated within the switching power supply 190 and shown at FIG. 14B. When operating in SEPIC, load W4 in FIG. 14B is a zero ohm jumper 250 which is loaded instead of the circuit including npn amplifier 336, resistor 322, field effect transistor (FET switching) 186, component 264, resistor 272, and W3 (zero ohm jumper 251), which is only required in non-SEPIC operation to disconnect the load when the circuit is "off". When in SEPIC operation, an inherent disconnect feature is provided by L2, shown in FIG. 14C. This circuit obtains power from the lane module 128 and the voltage may exceed five volts. When operating from batteries 194 and 196, pnp general purpose amplifier 264 is required and serves to disconnect the batteries 194 and 196 from the regulator output when the switcher is shut down. Within the switching power supply 190 are resistors 252 and 254. Also present are capacitors 256, 258, 260, 262 and 263. Within FIG. 14C are operably connected resistors 270, 272, 274, 276 and 278. Also operably connected are capacitors 280, 282 and 284. Additionally, schottky diode 286 is operably connected in this portion of the circuit. In FIG. 14D and bridging into FIG. 14E are shown the optional circuit 193 for powering from an input switch and the power on/off circuit 221. Within the optional circuit 193 is schottky diodes 300, 310 and 312 and Zener diode 302 and capacitor 304. Within the power on/off circuit 221 are schottky diodes 310, 312, 314 and 316. Further, operably connected in this circuit are resistors 224, 320, 322, 324, 326, 328, 330 and 332. Also present and operably connected are pnp general purpose amplifier 334 and npn general purpose amplifier 336, both shown in FIG. 14D and npn general purpose amplifier 338, shown in FIG. 14E. FIG. 14F shows output to lane module 350 connecting through cable 14O to lane module 128. FIG. 14F also shows the output switch circuit 220. Within the output switch circuit 220 are operably connected schottky diodes 352 and 354. Also present and operably connected are resistor 356 and capacitor 358. Additionally, present and operably connected in/out switch circuit 220 is field effect transistor (FET switching) 360. In FIG. 14G is shown charge-transfer touch integrated circuit 154, preferably a model QT9701B2 IC of Quantum Research Group which serves as a charge transfer signal processor within the capacitive monitor circuit 164. Also shown is crystal 184, preferably operating at 20 MHz. Additionally shown are capacitors 370, 372, 374 and 376. FIG. 14H shows the sampling switch 206, the charge cancellation capacitors 210 and the sampling capacitors 166. Present in these circuits are capacitors 388, 390, 392, 394, 396, 398 and 400. Also present and operably connected in the sampling switch 206 is field effect transistor (FET switching) 402. FIG. 14I shows Op Amp with gain circuit 172. Within this circuit are resistors 410, 412 and 414. Also present is capacitor 418. Also present within this portion of the circuit is a feedback amplifier 404. In FIG. 14J is shown an optional voltage follower amplifier circuit 430 including a feedback amplifier 432. Presently, this component is not employed but is shown, if it is found desirable, to employ a driven shield configuration to cancel additional background capacitance. Also shown is a clamping circuit 436 which serves to protect sense lines from transients. The circuit includes resistors 438, 440, 442 and 444. Within the clamping circuit 436 are switching diodes 446 and 448. Also shown are leads to the conductive sense electrode 152 and the conductive shield electrode 156. FIG. 14K shows a circuit for calibration/initiation pads 450 used in manufacture. Within this circuit are resistors 452 and 454. Additionally, the serial EEPROM circuit 168 which stores settings is shown. This circuit has a capacitor 460, a resistor 462, and an easily erasable programmable read-only memory or EEPROM 464. FIG. 14L shows the parasitic power circuit 178. It includes schottky diodes 470 and 472 and a resistor 474, as well as Zener diode 475. FIG. 14M shows portions of the circuit including loads 180 and 182. FIG. 14N shows digital-to-analog converter 170 which includes a serial input dual voltage output 8-bit DAC 479. Also, within this portion of the circuit are capacitors 476 and 478. FIG. 14O shows RS-232 transceiver 174 which interfaces with PC 176. Within this portion of the circuit are capacitors 480, 482, 484, 486 and 487. Resistors 488 and 490 are also present, as is a schottky diode 492.

Figure 15:
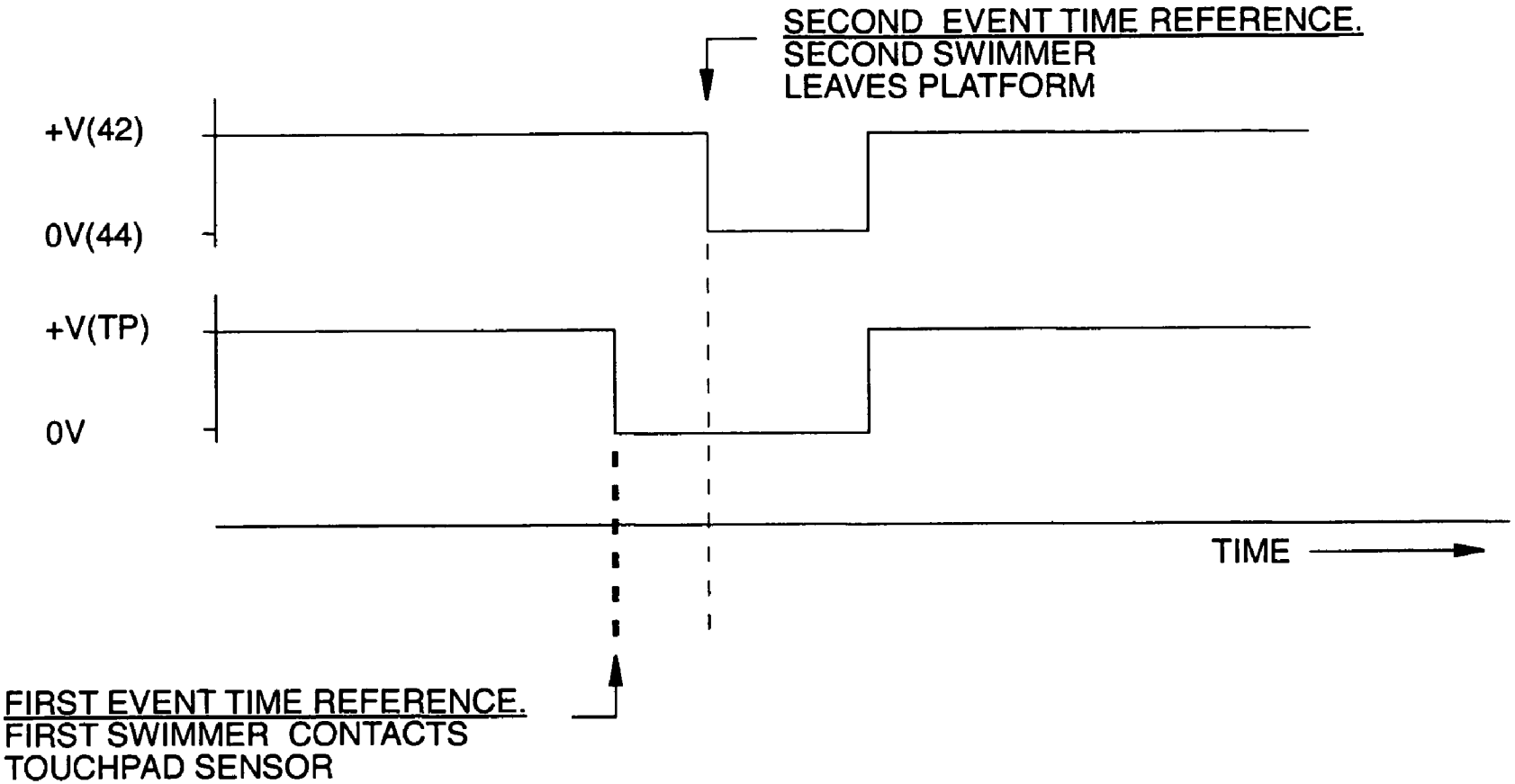
FIG. 15 illustrates a typical time interval and comparison measured by the capacitive relay takeoff swimming platform alternative embodiment sensor system; and, FIG. 16 illustrates a time interval and comparison measured by the capacitive relay takeoff swimming platform alternative embodiment sensor system where a second swimmer departs early.
Figure 16:
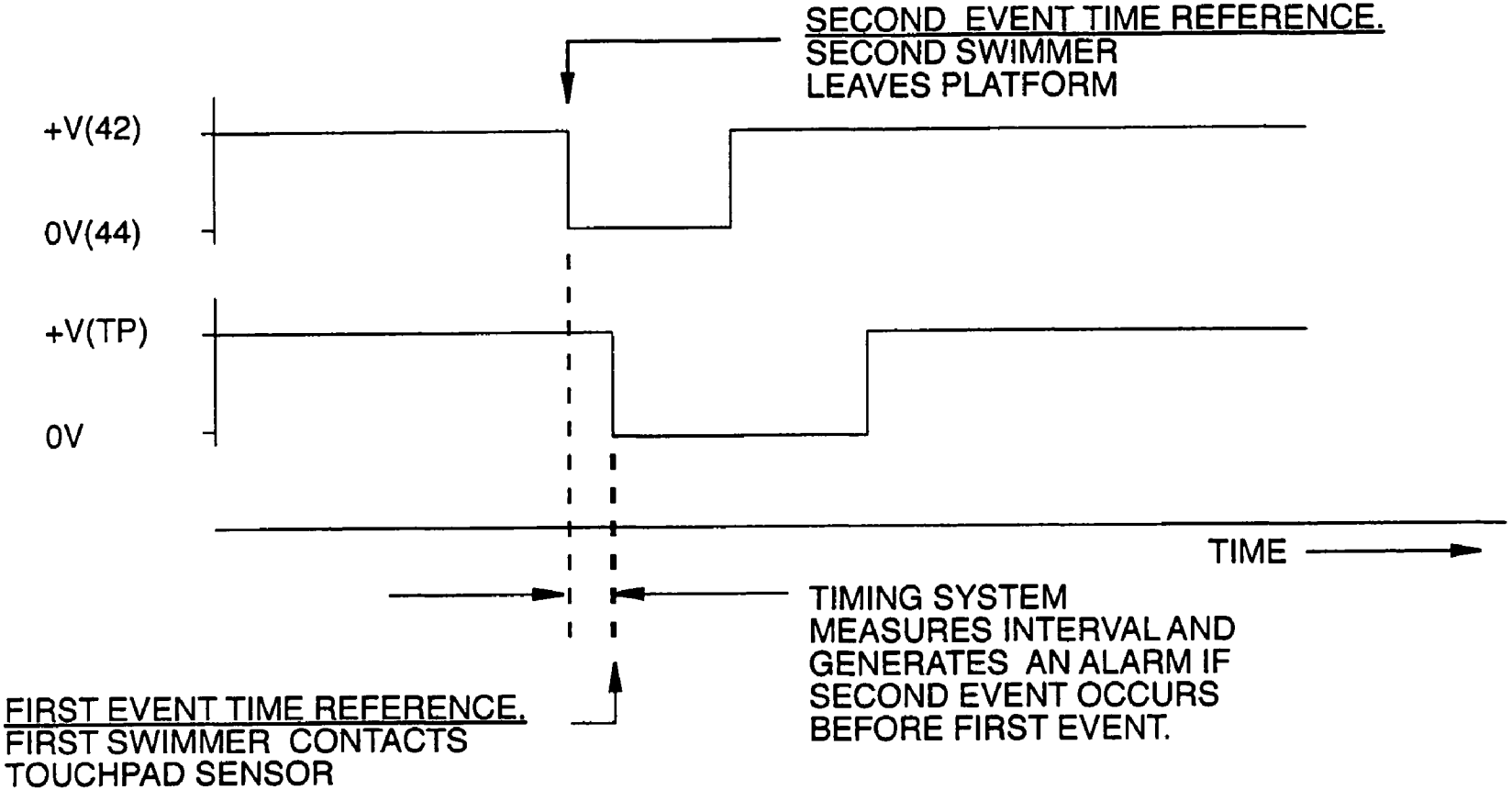

FIGS. 15 and 16 illustrate a time interval comparison measured by the capacitive relay takeoff swimming platform sensor system 109. A first event time reference is established when a low voltage at the touchpad sensor 126 is detected upon the first swimmer contacting the touchpad sensor 126, and a second event time reference is established when a low voltage is detected by the second swimmer leaving the sensor mat 118 on the relay takeoff swimming platform 116. The rules for swimming relays dictate that the first swimmer must touch the touchpad sensor 126 at the end of the swim lane before the second (successive) swimmer leaves the relay takeoff swimming platform 116. Under most circumstances, such sequence takes place, and this is illustrated in FIG. 15 where the time reference for the first event (viz., first swimmer contacting touchpad sensor 126) indicated by a bold dashed line appears before the time reference for the second event (viz., second swimmer leaving platform 116) denoted by a fainter dashed line. Ideally, and for maximum proficiency in a swimming relay, the time references for the first and second events would coincide, and relay teams strive to achieve this ideal. However, occasionally the second event occurs before the first event. When this happens, a disqualification may occur. If the second event time reference occurs prior to the first event time reference, such sequence is noted, and notification thereof can be made visually or audibly by the timer 132 to denote an irregular relay sequence.

FIG. 16 illustrates an example of the second event occurring prior to the first event, which sequence may be termed a negative exchange or an illegal exchange. In this scenario, the timing system will record a negative exchange time, indicating the system detected an illegal exchange.

Various modifications can be made to the present invention without departing from the apparent scope thereof.

What is claimed is:

1. A capacitive takeoff swimming sensor system, the system comprising:

a sensor mat including a swimmer occupiable region along the surface of the sensor mat to capacitively detect the presence of a swimmer and a perimeter about the swimmer occupiable region;

a sensor circuit in electrical communication with the sensor mat, the sensor circuit including an automatic recalibration charge-transfer touch integrated circuit for determining a first level where the mat is vacant and for determining a second sensor level where a swimmer is occupying the occupiable region on the mat;

a power supply; and a monitor circuit that determines the takeoff of a swimmer from the sensor mat by monitoring the change in capacitance level in the swimmer occupiable region based on the first and second sensor levels monitored by the recalibration circuit.

2. The capacitive takeoff swimming sensor system of claim 1, wherein the sensor mat is situated upon a starting platform.

3. The capacitive takeoff swimming sensor system of claim 2, wherein the starting platform is a relay takeoff swimming platform.

4. The capacitive takeoff swimming sensor system of claim 1, wherein a portion of the sensor mat is substantially vertically oriented for physical contact with at least a portion of a toe of the swimmer.

5. The capacitive takeoff swimming sensor system of claim 1, wherein a portion of the sensor mat is substantially horizontally oriented for physical contact with at least a portion of a foot of the swimmer.

6. The capacitive takeoff swimming sensor system of claim 1, wherein a portion of the sensor mat is substantially vertically oriented for physical contact with at least a portion of a toe of the swimmer and a contiguous portion of the sensor mat is substantially horizontally oriented for physical contact with at least a portion of a foot of the swimmer.

7. The capacitive takeoff swimming sensor system of claim 1, wherein the sensor mat has a textured non-slip surface for physical contact with the swimmer.

8. The capacitive takeoff swimming sensor system of claim 1, wherein the sensor mat includes a sensor electrode to monitor capacitance in a swimmer occupiable region along a surface of the sensor mat.

9. The capacitive takeoff swimming sensor system of claim 1, wherein the sensor mat includes multiple layers.

10. The capacitive takeoff swimming sensor system of claim 9, wherein the multiple layers of the sensor mat are bonded.

11. The capacitive takeoff swimming sensor system of claim 10, wherein the multiple layers of the sensor mat are bonded by adhesive.

12. The capacitive takeoff swimming sensor system of claim 1, wherein the sensor mat is a laminate structure.

13. The capacitive takeoff swimming sensor system of claim 12, wherein the sensor mat laminate structure includes, in laminated order, an exterior layer, an insulative layer, a conductive sense electrode layer, an insulative layer, a conductive shield electrode layer, and an insulative layer.

14. The capacitive takeoff swimming sensor system of claim 13, wherein the exterior layer is generally clear and includes a sand-paper like textured non-slip surface.

15. The capacitive takeoff swimming sensor system of claim 12, wherein the sensor mat laminate structure can assume a non-planar shape.

16. The capacitive takeoff swimming sensor system of claim 14, wherein the sensor mat laminate structure has printed indicia on the insulative layer interfacing with the exterior sand-paper like textured non-slip surface layer, which printed indicia are visible through the exterior layer.

17. The capacitive takeoff swimming sensor system of claim 1, wherein the sensor mat includes a polycarbonate perimeter.

18. The capacitive takeoff swimming sensor system of claim 17, wherein a portion of the sensor mat is substantially vertically oriented for physical and capacitive contact with at least a portion of a toe of the swimmer and another portion of the sensor mat, continuous with the substantially vertically oriented portion of the sensor mat, is substantially horizontally oriented for physical and capacitive contact with at least a portion of a foot of the swimmer and wherein the polycarbonate perimeter includes a plurality of grooves between the substantially vertically oriented portion and the substantially horizontally oriented portion, which plurality of grooves are folded to transition between the substantially vertically oriented portion to the substantially horizontally oriented portion.

19. The capacitive takeoff swimming sensor system of claim 18, wherein the sensor mat includes a conductive sensor electrode to monitor capacitance in the swimmer occupiable region along a surface of the sensor mat, which conductive sensor electrode is continuous in both the substantially vertically oriented portion of the sensor mat and the substantially horizontally oriented portion and in the folded plural groove transition therebetween.

20. The capacitive takeoff swimming sensor system of claim 19, wherein the sensor mat includes a conductive shield electrode, which conductive shield electrode is present in the substantially horizontally oriented portion of the sensor mat and absent from the substantially vertically oriented portion of the sensor mat and absent form the folded plural groove transition therebetween.

21. The capacitive takeoff swimming sensor system of claim 18, wherein the grooves of the plurality of grooves have sides defining an angle and the sum of angles of the grooves of the plurality of grooves is substantially equal to the angle between the substantially horizontally oriented portion and the substantially vertically oriented portion of the sensor mat.

22. The capacitive takeoff swimming sensor system of claim 21, wherein the plurality of grooves includes three grooves and each of the three grooves has about a 30 degree angle between sides of the groove.

23. The capacitive takeoff swimming sensor system of claim 20, wherein the conductive sense electrode and the conductive shield electrode are separated in part by a honey comb insulator layer and in part by the polycarbonate perimeter.

24. The capacitive takeoff swimming sensor system of claim 20, wherein the conductive sense electrode and the conductive shield electrode are separated in part by a polypropylene insulator layer and in part by the polycarbonate perimeter.

25. The capacitive takeoff swimming sensor system of claim 20, wherein the conductive sense electrode and the conductive shield electrode are each carried in a channel in the polycarbonate perimeter, and wherein the polycarbonate perimeter surrounds a polypropylene honeycomb insulator layer present in the substantially horizontally oriented portion of the sensor mat and absent from the substantially vertically oriented portion of the sensor mat and the plural grooved portion of the sensor mat.

26. The capacitive takeoff swimming sensor system of claim 1, wherein the automatic recalibrating charge-transfer touch integrated circuit is a QT9701 B2 capacitive sensor IC from Quantum Research Group.

27. The capacitive takeoff swimming sensor system of claim 1, wherein the sensor mat includes a conductive sense electrode and wherein the charge-transfer integrated circuit fosters projection of an electric field around the conductive sense electrode.

28. The capacitive takeoff swimming sensor system of claim 1, wherein the sensor mat includes a conductive sense electrode layer and a conductive shield electrode layer and wherein the monitor circuit is connected to the conductive sense electrode layer and the conductive shield electrode layer and wherein the monitor circuit includes a sampling capacitor.

29. The capacitive takeoff swimming sensor system of claim 28, wherein the sampling capacitor is selected to provide desired sensitivity relative to the capacitance across the sensor mat.

30. The capacitive takeoff swimming sensor system of claim 1, wherein the power supply is a battery circuit.

31. The capacitive takeoff swimming sensor system of claim 30, wherein the battery circuit may be visually monitored by observing an LED.

32. The capacitive takeoff swimming sensor system of claim 1, further comprising a test circuit with a light emitting diode to indicate battery voltage below a pre-selected level suitable for dependable swimmer departure sensing performance.

33. The capacitive takeoff swimming sensor system of claim 1, wherein the power is provided by an external device and a battery circuit, the battery circuit supplying power when the voltage from the regulated power supply is detected as insufficient.

34. The capacitive takeoff swimming sensor system of claim 1, wherein the capacitive takeoff swimming sensor system is one of a plurality of like sensor systems, each of the capacitive takeoff swimming sensor systems of the plurality dedicated to a single individual swimming lane in a multi-laned swimming pool and each providing swimmer takeoff information to a interconnected control system having optional capabilities for timing, relay touchpad previous swimmer lane information, scoreboard display, and starting.

* * * * *